US006389260B1

(12) United States Patent
Kataoka et al.

(10) Patent No.: US 6,389,260 B1
(45) Date of Patent: May 14, 2002

(54) TANDEM TYPE COLOR IMAGE FORMING DEVICE

(75) Inventors: Hiroshi Kataoka, Shiki-gun; Tadasu Taniguchi, Uda-gun; Keizo Fukunaga, Ikoma; Eiichi Kido, Yamatokoriyama; Jitsuo Masuda, Yamatotakada; Naoki Fukudo, Kashihara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/714,126

(22) Filed: Nov. 17, 2000

(30) Foreign Application Priority Data

Nov. 19, 1999 (JP) ..... 11-329181
Jul. 12, 2000 (JP) ..... 2000-211836

(51) Int. Cl.[7] ..... G03G 15/01
(52) U.S. Cl. ..... 399/298; 399/302; 430/47
(58) Field of Search ..... 399/298, 299, 399/302, 223, 231; 347/115, 116, 117, 118; 430/45, 47

(56) References Cited

U.S. PATENT DOCUMENTS 5,075,730 A * 12/1991 Hoshi ..... 399/302
5,270,138 A * 12/1993 Kaneko et al. ..... 430/45
5,313,259 A * 5/1994 Smith ..... 347/118 X
5,363,178 A * 11/1994 Matsumoto ..... 399/299
5,627,629 A * 5/1997 Takahashi et al. ..... 399/231
5,920,755 A * 7/1999 Nelson ..... 399/298

FOREIGN PATENT DOCUMENTS

| | | |
|---|---|---|
| JP | 62-169175 A | 7/1987 |
| JP | 3-5157 U | 1/1991 |
| JP | 5-341617 A | 12/1993 |
| JP | 7-271107 A | 10/1995 |
| JP | 2907944 B2 | 4/1999 |

* cited by examiner

*Primary Examiner*—Joan Pendegrass

(57) ABSTRACT

Toner image forming means for forming toner images having chromatic colors of Y, M and C, respectively, are disposed on one side of an intermediate transfer belt, while disposing toner image forming means for forming a black toner image on the other side of the intermediate transfer belt, alone and on a most downstream side of all the toner image forming means. Further, when a toner image on the intermediate transfer belt includes toner having a reverse polarity, a transfer or developing process is controlled to reduce electrostatic attraction force acting on an image carrier, thus providing a color image forming device having a main body reduced in size and capable of faster image formation of a monochromatic image which is more frequently used, and of efficiently forming a color image by suppressing a back-transfer phenomenon and improving color reproducibility.

19 Claims, 10 Drawing Sheets

TANDEM TYPE COLOR IMAGE FORMING DEVICE

FIELD OF THE INVENTION

The present invention relates to an image forming device including: toner image forming means for forming a toner image dealing with both colors and a black color to form color or monochromatic (black and white) images, respectively; an intermediate transfer belt onto which the toner image of the respective colors or the black color formed by the toner image forming means is transferred; and transfer means for transferring the toner image on the intermediate transfer belt onto a recording medium, and in particular to a color image forming device which is suitably miniaturized and can realize high image quality, further including a plurality of the toner image forming means per color, and arranging respective toner image forming means by a tandem method, while having the intermediate transfer belt for transferring the toner image.

BACKGROUND OF THE INVENTION

Conventionally, major color image forming devices such as a color photocopying machine and a color printer have an arrangement in which a plurality of developing devices are provided, each of which forms a visible image (toner image) of a different color, and these toner images are eventually transferred one over another onto the same recording paper (transfer paper).

Generally, the color image forming device having the plurality of the developing devices is roughly classified into two types: a single photoreceptor type (or a single drum type); and a tandem type (multiple-step drum type).

First of all, in the single photoreceptor type color image forming device, a color image is formed by switching and successively operating the plurality of the developing devices capable of developing respective colors with respect to one photoreceptor drum. As a plurality of colors usually used therefor are, for example, the four colors of yellow (hereinafter referred to as "Y"), magenta ("M", hereinafter), cyan ("C", hereinafter) and black ("Bk", hereinafter).

However, in the single photoreceptor type color image forming device, an image forming process (exposing, developing and transferring) is repeated for every color of the plurality of colors. For example, in the case of forming the color image with the four colors above, four developing devices are switched to be successively operated, so as to repeatedly perform image forming process for four times with respect to the photoreceptor drum.

Accordingly, in order to form one color image per one recording paper, four times a duration of time for image formation is necessary, thus requiring a considerable length of time for a whole image forming process. Therefore, in the single photoreceptor type color image forming device does arise a problem of the less counts of print per unit time, i.e., a slow image formation rate.

On the other hand, a tandem type color image forming device is made up of a plurality of toner image forming means having the photoreceptor drum and the developing device, each of which deals with each of the plurality of colors (four colors, for example), while juxtaposing these plurality of the toner image forming means per each color.

The following will describe one example of the tandem type color image forming device. For example, sequentially from an upper-stream side of a transport direction of a recording paper transport path for transporting recording paper which is a recording medium, respective image forming stations (toner image forming means) per respective colors of Y, M, C and Bk (black) are juxtaposed in a row (tandem), and in addition, a fixing device is provided on a downstream side of the recording paper transport path for these four image forming stations.

In the foregoing arrangement, first, recording paper which is static-absorbed with respect to the recording paper transport path is carried to the image forming station. Next, the toner images of the respective colors formed on respective photoreceptor drums are successively transferred one over another onto the recording paper. Thereafter, the recording paper after the transfer is carried to the fixing device in which fusion-pressurization fixation (fixing by applying heat and pressure) is performed on the toner image yet to be fixed on the recording paper, thus forming a color image on the recording paper.

Thus, in the tandem type color image forming device, the toner images of respective colors are formed by the image forming stations (toner image forming means) which are provided per color, and therefore, virtually, only a single step of the image forming process is required. Therefore, on a simple calculation, about four times a processing rate can be realized compared with the single photoreceptor type, and the problem of the slow image formation rate in the single photoreceptor type is cleared, thereby making it possible to realize a faster color image forming process.

Further, since, in the tandem type, as many photoreceptors and developing devices as types of color to be formed are needed, problems arise in terms of (i) an increase in the number of components, (ii) complication of manufacturing steps, and (iii) a rise in manufacturing costs. However, in recent years, an internal device has been miniaturized and composed in a unit (become a set device). This prevented the manufacturing steps from becoming more complicated and requiring higher costs, and the internal device has become relatively inexpensive. Accordingly, as far as the color image forming devices are concerned, the tandem type has been becoming the mainstream thereof, taking the place of the single photoreceptor type.

In the tandem type, however, the plurality of the image forming stations each of which is provided for each color are all set to be sequentially juxtaposed from the upper-stream side of one phase of the recording paper transport path. Accordingly, this causes the recording paper to be carried through as many transport paths as the plurality of the image forming stations. As a result, the transport path becomes long, which raises such a problem that the size of the tandem type color image forming device increases more than the single photoreceptor type.

Recently, therefore, there have been proposed various color image forming devices having the purpose of settling problems arisen in the single photoreceptor type and the tandem type, respectively. Typical techniques include color image forming devices disclosed, for example, in 1̂ Japanese Unexamined Patent Publication No. 169175/1987 (Tokukaisho 62-169175 published on Jul. 25, 1987), 2̂ Japanese Unexamined Utility Model Publication No. 5157/1991 (Jitsukaihei 3-5157 published on Jan. 18, 1991), 3̂ Japanese Patent No. 2907944 (Publication No. Tokukaihei 4-13161 published on Jan. 17, 1992), 4̂ Japanese Unexamined Patent Publication No. 341617/1993 (Tokukaihei 5-341617 published on Dec. 24, 1993) and 5̂ Japanese Unexamined Patent Publication No. 271107/1995 (Tokukaihei 7-271107 published on Oct. 20, 1995).

First, the technique 1̂ relates to a tandem type color image forming device, and as shown in FIG. 7, in an image forming section are juxtaposed four image forming stations 102*a*, 102*b*, 102*c* and 102*d* each of which deals with each color of Y, M, C or Bk, and besides, an intermediate transfer medium 103 having the shape of a belt is provided so that it commonly opposes to photoreceptor drums (not shown) in these image forming stations 102*a* through 102*d*. In other words, the four image forming stations 102*a* through 102*d* are disposed side by side on an upper side of the color image forming device, while on a lower side is disposed the intermediate transfer medium 103. The intermediate transfer medium 103 is rotatable in a direction of an arrow in the drawing.

In the foregoing arrangement, toner images having respective colors of Y, M, C and Bk are superimposed on a surface of the intermediate transfer medium 103. Thereafter, the toner images thus superimposed is transferred by a transfer device 104 onto a sheet of recording paper which was carried through a recording paper transport path, then, fixed on the sheet of recording paper by a fixing device 105.

In the technique ①, by suspending the intermediate transfer medium 103 having the shape of the belt in substantially a triangular shape, the transfer device 104 and fixing device 105 can appropriately be disposed in a spacing on the lower side of the device, without juxtaposing them as in the case of the image forming stations 102*a* through 102*d*. Consequently, the spacing within the device can be utilized efficiently, thus miniaturizing the color image forming device.

Next, the technique ② relates to a color image forming device taking a middle position between the single photoreceptor type and the tandem type, and as shown in FIG. 8, first, in the image forming section is used a photoreceptor having the shape of a belt (photoreceptor belt 113) to be suspended in a vertical direction with respect to a formation direction of a recording paper transport path 106, by suspension rollers 107. This photoreceptor belt 113 is rotatable in a direction of an arrow in the drawing.

Then, on a side of a direction which is an upper-stream side of a rotation direction of the photoreceptor belt 113 is disposed exposing means 108 (which exposes the photoreceptor belt 113 to form an electrostatic latent image thereon), and a Bk developing device 112*d* is disposed on the same phase and a downstream side of the exposing means 108, and further on a side of the other direction of the photoreceptor belt 113 are juxtaposed developing devices 112*a*, 112*b* and 112*c* per each color of Y, M and C. In addition, on a downstream side of the developing device 112*c* of C is disposed one suspension roller 107 to which the recording paper transport path 106 and transfer device 104 are connected.

In the foregoing arrangement, on a surface of the photoreceptor belt 113, from the upper-stream side thereof, the toner images of Bk, Y, M and C are successively formed by superimposing one over another. Then, the toner images which were superimposed one over another are transferred onto a sheet of the recording paper which was transported by the recording paper transport path 106. Thereafter, by the fixing device 105 is fixed the toner image which was transferred onto the sheet of the recording paper, thus forming a color image.

In the technique ②, since the photoreceptor belt 113 is suspended in a vertical direction with respect to the formation direction of the recording paper transport path 106, there is no need to juxtapose the respective developing devices 112*a* through 112*d* of Y, M, C and Bk, while, as in the case of the simple single photoreceptor type, it is not necessary to repeat a process for forming the toner image of each color for four times, thereby realizing both miniaturized and high-speed color image forming device.

Next, the technique ③ also relates to a color image forming device taking a middle position between the single photoreceptor type and the tandem type. With this technique, as shown in FIG. 9, it is the same as the technique ② (or ①) that the photoreceptor belt 113 is used (or the intermediate transfer medium may be used instead) in the image forming section; however, other than the respective developing devices 112*a* through 112*d* of Y, M, C and Bk (or they may be the image forming stations instead), exclusive to a black and white image (monochromatic image), a fifth developing device 112*e* (or it can be an image forming station instead) for forming a toner image of Bk is included.

In the foregoing arrangement, when forming a color image, an image is formed in the first through fourth developing devices 112*a* through 112*d* corresponding to the four colors of Y, M, C and Bk, which is transferred onto a sheet of the recording paper by the transfer device 104 and fixed by the fixing device 105, while in the case of forming black and white image, a toner image of Bk is formed by the fifth developing device 112*e* alone, which is transferred onto a sheet of the recording paper by the transfer device 104 and fixed by the fixing device 105, thus miniaturizing the device while increasing a first copying speed of black and white image formation which is most frequently used in image formation.

Next, the technique ④ also relates to a color image forming device taking a middle position between the single photoreceptor type and the tandem type. With this technique, as shown in FIG. 10, by using the intermediate transfer medium 103 which is used in technique ①, the image forming stations 102*a* through 102*c* of the respective colors of Y, M and C are disposed opposing to the intermediate transfer medium 103, while an image forming station 102*d* of Bk which is frequently used in image formation is disposed independently, apart from the image forming stations 102*a* through 102*c* of the other three colors.

In the foregoing arrangement, when forming a color image, the toner images of the respective colors of Y, M and C are tentatively transferred onto the intermediate transfer medium 103 before being transferred onto a sheet of the recording paper by the transfer device 104, and thereafter, in a Bk image forming station 102, a toner image of Bk is transferred onto a sheet of the recording paper and fixed by the fixing device 105. On the other hand, when forming a black and white image, an image is formed in the Bk image forming station 102*d* alone, skipping the intermediate transfer medium 103, and only the toner image of Bk is transferred onto a sheet of the recording paper and fixed by the fixing device 105, thereby miniaturizing the device on account of the intermediate transfer medium 103 while realizing faster image formation of a black and white image which is frequently used.

Further, the technique ⑤ relates to a tandem type color image forming device, and moreover, it employs a high viscosity liquid developer for a color image, in which charged toner is dispersed within insulating liquid with high density.

In this technique, in addition to the arrangement in which the image forming stations of the four colors of Y, M, C and Bk are simply juxtaposed, as shown in FIG. 11, an arrangement is disclosed such that, in the image forming section, for example, an intermediate transfer medium having the shape of a belt is suspended in a horizontal direction, and the recording paper transport path 106 is formed in the vertical direction so as to oppose to the transfer device 104, then, the image forming stations of every two colors are juxtaposed in positions which are over and under the intermediate transfer medium 103. For example, in FIG. 11, the image forming stations 102*a* and 102*b*, and the image forming stations 102*c* and 102*d* are juxtaposed, respectively. Note that, in the example of FIG. 11, the recording paper is transported from down to up in the vertical direction, and thereby the fixing device 105 is disposed in an upper direction of the device.

With the foregoing arrangement, an image forming device can be miniaturized because a device width of a whole color image forming device is not more than a total width of the image forming stations 102*a* and 102*b* (or 102*c* and 102*d*), while a color image forming device capable of faster image formation, high resolution and less pollution can be provided because of the use of the liquid developer.

However, any one of the color image forming devices of the respective arrangements above raises a problem of not being capable of fully realizing miniaturization of the device and the faster image formation.

First, in the technique ①, the Bk image forming station 102*d* is juxtaposed with the image forming stations 102*a* through 102*c* of the other colors. Therefore, as seen in problems to be solved in the techniques ③ and ④, there arises a problem of difficulty in realizing faster black and white image formation which is frequently used.

Further, in the technique ②, as in the technique ①, it is difficult to realize faster black and white image formation. More specifically, in an electrophotographic color image forming device, in order to adjust itself to highly frequent black and white image formation, not only simply faster image formation speed but also a larger toner storing capacity of a Bk developing device (or image forming station), i.e., the larger size of the Bk developing device are necessary.

However, in the technique ②, due to the arrangement, the exposing means 108 requires to be juxtaposed with either one of the developing devices 112*a* through 112*d*, and moreover, in order to increase the size of the Bk developing device 112*d* while avoiding increasing the size of a whole device, it is necessary to dispose the exposing means 108 and Bk developing device 112*d* on a side of the same plane of the photoreceptor belt 113. This, therefore, results in disposing the Bk developing device 112*d* of all the developing devices 112*a* through 112*d* on the most upper-stream side, which causes difficulty in realizing faster black and white image formation.

Further, in the technique ③, while realizing faster black and white image formation, the fifth developing device 112*e* exclusive to a black and white image is provided, other than the Bk developing device 112*d* for a full color. As a result, twice as many the Bk developing device or the image forming station should be provided, which results in increasing the number of components and costs accordingly, complicating manufacturing steps, and increasing capacity of a color image forming device, and thereby preventing a whole device from being sufficiently miniaturized.

On the other hand, in the technique ④, in order to realize faster black and white image formation, the Bk image forming station 102*d* is separately provided, apart from the image forming stations 102*a* through 102*c* of the other colors formed by integrating them with the intermediate transfer medium 103. Accordingly, it is not necessary to provide twice the number of the Bk image forming stations, and it is possible to increase the size of the Bk image forming station 102*d*, and further, unlike the technique ③, the problems such as the largely increased number of components and increased capacity can be prevented. However, the suspension of the intermediate transfer medium in the vertical direction causes a problem of increasing the vertical direction (height) of the device.

Further, in the technique ⑤, since every two of the image forming stations 102*a* and 102*b* or 102*c* and 102*d* are disposed over and under the horizontally suspended intermediate transfer medium 103, as in the case of the technique ①, in effect, it becomes similar to a state in which the Bk image forming station 102*d* is juxtaposed with the image forming stations 102*a* through 102*c* of the other colors. As a result, there arises such a problem that realizing faster black and white image formation is difficult.

Further, the respective color image forming devices above have an arrangement including a plurality of image forming stations disposed side by side, or an arrangement including a plurality of developing devices which are juxtaposed as in the manner of an intermediate type between the single photoreceptor type and the tandem type; however, such arrangements may result in deterioration of image quality, which is called a back-transfer phenomenon. This back-transfer phenomenon is such that unfixed toner which was tentatively transferred onto a sheet of the recording paper (or the intermediate transfer medium) in the plurality of the image forming stations (or developing devices) is caught by an image forming station disposed on a closest downstream side, and therefore, a desirable color image is not formed.

The foregoing back-transfer phenomenon will be explained more specifically with reference to, for example, the technique ① shown in FIG. 7. In the case of forming a color image of the four colors of Y, M, C and Bk, first, a toner image of a first color Y, which was formed in a developing process of the Y image forming station 102*a* of the most upper-stream, is transferred onto a sheet of the recording paper. The recording paper having the toner image of Y transferred thereon is transported to a position of the next image forming station 102*b* of M, and a toner image of a second color M which was formed in a developing process of the M image forming station 102*b* is transferred onto a sheet of the recording paper by superimposing one over another.

However, when transferring the M toner image, a portion of the unfixed Y toner image previously transferred is reverse-transferred with respect to a photoreceptor (not shown) of the M image forming station 102*b*. The same phenomenon can be seen in the cases of transferring a toner image of a third color C and of transferring a toner image of a fourth color Bk.

To this end, on the recording paper after the toner image of the fourth color Bk was transferred in the Bk image forming station 102*d* of the most downstream, the amount of the adhering toner of the toner image of the first color Y shows a decrease of tens of percent against an original adhesion amount, due to an occurrence of the back-transfer phenomenon. Such decrease in the adhesion amount is also shown in the cases of the toner images of the second color M and the third color C.

Namely, the earlier a toner image is transferred, the less the amount of toner to adhere becomes, compared with a desired amount of toner to adhere. Consequently, when, for example, forming the respective toner images of four colors so as to transfer them onto the recording paper in one image forming process, assuming that toner of the respective colors each having the same amount as the others is transferred and adheres with respect to the recording paper, it would essentially satisfy 'Y (a first color) adhering amount' 'M (a first color) adhering amount'='C (a first color) adhering amount'='Bk (a first color) adhering amount'. However, when the back-transfer phenomenon occurs, a relation among them becomes 'Y (the first color) adhering amount'<'M (the first color) adhering amount'<'C (the first color) adhering amount'<'Bk (the first color) adhering amount', which results in an unbalanced color scheme.

In the foregoing case, for example, since the toner amount of Y as the first color becomes the least of all, one feels that a Y component in a whole image is thinner than the other colors. This causes reduction in chroma in the case of using a single Y-component, and moreover, it even causes change in a hue in the case of using a color formed by a mixture of Y. The same phenomenon is observed in the cases of M as a second color and C as a third color, i.e. the earlier a color is transferred, the thinner the density becomes, and relatively, the later a color is transferred, the thicker the density becomes. Thus, the balance of a color scheme of a color image as a whole largely deteriorates in comparison with that of an original color image.

Causes of the foregoing back-transfer phenomenon include the following. Namely, when toner from a developing roller adheres to the photoreceptor (development is performed) in accordance with an image voltage of the photoreceptor (drum or belt) in the image forming process, not all the toner is always charged with a uniform voltage. Therefore, toner adhering to the photoreceptor includes toner having a weak polarity and toner having a charge of a reverse polarity mixed therein. Furthermore, there may be a case where an electrical discharge occurs in a process of transferring the toner image onto the recording paper so as to remove the recording paper from the photoreceptor. This electrical discharge causes to generate toner which is to have the reverse polarity later.

In case where a toner image including these toner having the weak polarity and toner having the reverse polarity receives a transfer charge in a transfer process of the following stage, when the toner has a normal charge, the transfer charge does not change the polarity of the toner, and repulsive force acts between the toner on the recording paper and photoreceptor so as to maintain the toner to adhere to the recording paper, while, in the case of the toner having the reverse polarity, the transfer charge also has the reverse polarity, and therefore, electrostatic attraction force acts from the recording paper to a side of the photoreceptor, thus the toner having the reverse polarity returns from the recording paper to the side of the photoreceptor.

SUMMARY OF THE INVENTION

In view of the foregoing problems, it is an object of the present invention to provide a color image forming device capable of (1) reducing the size of an entire device, (2) increasing the size of an image forming station of a black color which is frequently used in image formation, or a developing device, (3) increasing the speed of an image forming process, particularly the speed of a black and white (monochromatic) image forming process which is frequently used in image formation, and (4) suppressing occurrence of a back-transfer phenomenon so as to effectively form a color image with superior color reproducibility.

Namely, in order to attain the foregoing object, the color image forming device according to the present invention includes a plurality of image forming stations for respectively forming toner images of different colors, and an intermediate transfer belt on which the toner images which are respectively formed by the plurality of image forming stations are successively transferred one over another, the image forming device further including, as the plurality of image forming stations, one or more chromatic color image forming stations for forming a toner image having a chromatic color, and only one black image forming station for forming a toner image having a black color, and the intermediate transfer belt being suspended in a shape of a substantially flat plate by at least two suspension rollers inside a main body, and the chromatic color image forming stations being disposed on one side of the suspended intermediate transfer belt, and the black image forming station being disposed on the other side of the intermediate transfer belt, alone and on a most downstream side of all the image forming stations.

With the foregoing arrangement, with respect to the chromatic color image forming stations, the black image forming station is virtually provided independently. Consequently, not all the plurality of image forming stations are to have a tandem disposition, thereby suppressing increase in size of the entire device and increasing the size of the image forming station of the black color which is frequently used in image formation.

Moreover, when forming a monochromatic image, processing speed of the black image forming station can be increased, thereby further increasing first copying speed of monochromatic image formation and increasing speed of monochromatic image formation.

In the color image forming device, the black image forming station has a shape of a substantially flat plate which extends two-dimensionally, and is disposed so that a direction of the two-dimensional extension coincides with a suspending direction of the intermediate transfer belt.

With the foregoing arrangement, since the black image forming station itself is formed in a shape of the substantially flat plate, the shape coincides with a shape of the intermediate transfer belt in the suspending direction. Therefore, the black image forming station can be disposed along the suspending direction of the intermediate transfer belt, thereby making effective use of space inside a main body.

In the color image forming device, it is preferable that the black image forming station includes a substantially cylindrical photoreceptor drum for carrying an electrostatic latent image, a developing device for developing the electrostatic latent image into a toner image with toner, and a developer tank for storing toner, wherein the photoreceptor drum, the developing device and the developer tank are disposed side by side in one direction in this order, which takes a form of the substantially flat plate.

With the foregoing arrangement, since it is possible to form the developer tank and the developing device to extend in a form of a flat plate, a storing capacity of toner can be increased in size so as to store the amount of toner corresponding to monochromatic image formation which is frequently used in image formation.

In the color image forming device, inside the main body of the device, the intermediate transfer belt is suspended in a substantially horizontal direction, and a sheet feeder cassette for storing a recording medium on which a toner image is finally transferred is disposed along the suspending direction of the intermediate transfer belt, and the black image forming station is disposed in a spacing having a shape of a substantially flat plate between the intermediate transfer belt and the sheet feeder cassette.

With the foregoing arrangement, the black image forming station which is disposed alone is disposed in the spacing having the shape of the substantially flat plate between the intermediate transfer belt and the sheet feeder cassette. Therefore, the black image forming station can be stored with no space, thereby effectively using a spacing having the shape of the substantially flat plate inside the main body of the device.

Particularly, this spacing having the shape of the substantially flat plate, though lacking a three-dimensional extension (the size in a direction of height of a device main body), has a sufficient two-dimensional extension (the size in a horizontal direction). Therefore, by forming the developing device and the developer tank of the black image forming station in a shape of a flat plate, these can be increased in size, and the developing device can use, as developer of Bk, two-component developer including toner and carrier as main components.

The color image forming device further includes a transfer roller for finally transferring a toner image, which has been transferred onto the intermediate transfer belt, to a sheet of recording paper, a fixing device for fixing the toner image, which was finally transferred, on the sheet of recording paper, and a recording paper transport path for transporting the sheet of recording paper from a sheet feeder cassette to the fixing device via the transport roller, wherein: the intermediate transfer belt is suspended in a substantially horizontal direction inside the main body, and the recording paper transport path is disposed in a substantially vertical direction, and the sheet feeder cassette is disposed in a lower part of the main body.

With the foregoing arrangement, the fixing device which is to reach a high temperature is disposed in an upper position, thus making it possible to increase a spacing between the intermediate transfer belt and the fixing device, thereby preventing fusion of toner into the intermediate transfer belt due to an influence of the heat of the fixing device, while, in the case of having a cleaning device, preventing decay of a blade of the cleaning device.

Further, the color image forming device preferably has an arrangement in which the sheet feeder cassette includes a feeder roller for feeding the recording paper in the recording paper transport path, and the black image forming station is disposed in a spacing having a shape of a substantially flat plate between the intermediate transfer belt and the sheet feeder cassette so that a photoreceptor drum comes closer to the feeder roller.

With the foregoing arrangement, the photoreceptor drum which has a relatively small capacity is disposed on a side of the feeder roller which is a projecting member, while the developer tank which requires a larger capacity is disposed in a position which is opposite to the feeder roller which is the projecting member, thereby making effective use of the space having the form of the substantially flat plate, while increasing the capacity of the developer tank in the black image forming station which is more frequently used in image formation, without increasing the size of the entire device in the direction of height.

In the color image forming device, it is preferable that a diameter of the photoreceptor drum included in the black image forming station is formed to be larger than a diameter of a photoreceptor drum included in the chromatic color image forming station.

With the foregoing arrangement, since, in the black image forming station, the diameter of the photoreceptor drum is large, thereby suppressing reduction in a film of a photosensitive film due to variation with time, and realizing a longer life cycle. Consequently, when forming a toner image of a black color which is frequently used in image formation, a longer period of time for use of a photoreceptor drum before replacement (reducing the number of time for replacement), and increasing ease of use.

In the color image forming device preferably includes either one of a laser scan unit and a light-emitting diode array so as to allow the plurality of image forming stations to expose a surface of an image carrier for carrying an electrostatic latent image so as to form the electrostatic latent image.

With the foregoing arrangement, both laser scan unit (LSU) and light-emitting diode array (LED array) are to be suitably used in image formation based on digital information, in a particular case where the color image forming device of the present invention is a digital color image forming device, a high-quality color image can be formed.

In the color image forming device, it is preferable that the chromatic color image forming station includes the light-emitting diode array.

With the foregoing arrangement, since the chromatic color image forming stations has the tandem disposition, the size of the device main body in a vertical direction (direction of height) can be greatly reduced when using the light-emitting diode array (LED array) which becomes much smaller than the LSU and the like.

The color image forming device preferably includes a cleaning device for cleaning residual toner on the intermediate transfer belt, wherein: the intermediate transfer belt which is suspended in the shape of the substantially flat plate is suspended by two suspension rollers which are disposed adjacently in a substantially vertical direction, and by one suspension roller which is disposed in a position apart from the two suspension rollers, and the cleaning device is disposed so as to face the intermediate transfer belt which is suspended in a substantially vertical direction by the two suspension rollers which are disposed adjacently.

With the foregoing arrangement, since the feeder roller, the suspension roller and the transfer roller can be disposed adjacently, space can be utilized more efficiently. Moreover, since the cleaning device is disposed on a substantially vertical side between the adjacently disposed suspension rollers, it is unnecessary to dispose the cleaning device next to the image forming station side by side, thereby reducing space of the device main body in a direction of both sides.

Further, the cleaning device is disposed on a substantially vertical portion, and therefore, when cleaning residual toner on the intermediate transfer belt, the residual toner which is scraped with a blade, etc., can be received in a lower part, thus cleaning the residual toner by utilizing the own weight of toner.

In the color image forming device, it is preferable that one of at least two suspension rollers suspending the intermediate transfer belt is disposed upper than the other suspension roller with respect to a horizontal direction so as to suspend the intermediate transfer belt with a tilt.

With the foregoing arrangement, making it possible to reduce the size of a spacing between a plurality of exposing means and to increase a capacity of a developer tank of the black toner image forming means, the size of a spacing of installation can also be reduced, thereby reducing the size of the image forming device in a width direction, and reducing the size of the spacing of installation.

In the color image forming device, it is preferable that the black image forming station uses two-component developer including toner and carrier, and the chromatic color image forming station uses one-component developer including toner.

With the foregoing arrangement, in the chromatic color image forming station, one-component developer is sued, thereby reducing the size of the chromatic color image forming station, and increase in size of the device main body in a horizontal direction can be suppressed. On the other hand, the black image forming station uses two-component developer, thereby realizing a longer life cycle of the developing device and increasing the speed of forming a black toner image.

Further, in order to solve the foregoing problems, the image forming device according to the present invention includes a plurality of image forming stations for forming and transferring toner images onto an intermediate transfer belt are disposed side by side along a transport or moving direction of the intermediate transfer belt so as to allow the plurality of toner images to be successively transferred one over another with respect to the intermediate transfer belt, and the plurality of image forming stations have an intermediate transfer roller for transferring the formed toner images to the intermediate transfer belt, and a transfer voltage of the intermediate transfer roller in an image forming station on a downstream side of the transport or moving direction is set to be lower than a transfer voltage of the intermediate transfer roller in an image forming station on an upstream side.

With the foregoing arrangement, the transfer voltage of a toner image is decreased toward a downstream side. Therefore, even when a preceding toner image includes reversely charged toner or weakly charged toner, an electrostatic attraction force acting between the reversely charged toner or weakly charged toner and the photoreceptor drum also becomes smaller. As a result, back-transfer of toner from the intermediate transfer belt to a surface of the photoreceptor drum is suppressed, thus effectively preventing occurrence of a back-transfer phenomenon in the image forming stations of the downstream side, thereby forming a high-quality image.

Alternatively, the present invention may be adopted so that the charged quantity of toner used in the image forming station of the downstream side in the transport or moving direction is set to be lower than the charged quantity of toner used in the image forming station of the upstream side.

Here, the charged quantity of toner is preferably set by at least one of the following methods: a method of selecting the type of charge controlling agent, a method of selecting the type of external additives of toner, a method of changing the amount of charge controlling agent added, a method of changing the dispersed state of charge controlling agent, and a method of varying the pressure of contact of the doctor blade for charging toner.

With this arrangement, the charged quantity of developer, i.e., toner is decreased toward the downstream side. Thus, even when the preceding toner image include reversely charged toner or weakly charged toner, the transfer voltage applied to transfer the later toner image can be decreased, and the electrostatic attraction force acting between the reversely charged toner or weakly charged toner and the photoreceptor drum also becomes smaller. As a result, back-transfer of toner from the intermediate transfer belt to the surface of the photoreceptor is prevented, thus effectively preventing occurrence of the back-transfer phenomenon in the image forming stations of the downstream side, thereby forming a high quality image.

Alternatively, the present invention may be adopted so that the image forming station includes the photoreceptor drum for carrying an electrostatic latent image, and a developing device for developing the electrostatic latent image which is carried on the photoreceptor drum, and the developing potential of the developing device of the image forming station of the downstream side of the transport or moving direction is set to be lower than the developing potential of developing device of the image forming station of the upstream side.

Here, the developing potential is preferably set by the method of varying the applied voltage to the developing device while holding the electrostatic latent potential constant, or by the method of varying the electrostatic latent potential while holding the applied potential to the developing device constant.

With this arrangement, the developing potential $|V_L - Vbias|$ used to develop the electrostatic latent image on the photoreceptor drum with toner is made smaller toward the downstream side. Thus, the electrostatic attraction force acting between the reversely charged toner or weakly charged toner and the photoreceptor also becomes smaller. As a result, back-transfer of toner from the intermediate transfer belt to the surface of the photoreceptor drum is prevented, thus effectively preventing occurrence of the back-transfer phenomenon in the image forming stations of the downstream side, thereby forming a high quality image.

Alternatively, the present invention may be adopted so that the particle size of toner used in toner image forming means of the downstream side in the transport or moving direction is set to be larger than the particle size of toner used in image forming station of the upstream side.

With this arrangement, the particle size of developer, i.e., toner is made larger toward the downstream side. Thus, the electrostatic attraction force required for toner movement becomes relatively larger. Therefore, even when the preceding toner image includes reversely charged toner or weakly charged toner, toner movement is prevented even when there is an electrostatic attraction force which would move normal toner in transfer of the later toner image, thus reducing the electrostatic attraction force acting between the reversely charged toner or weakly charged toner and the surface of the photoreceptor drum. As a result, back-transfer of toner from the intermediate transfer belt to the surface of the photoreceptor drum is prevented, thus effectively preventing the back-transfer phenomenon in the image forming stations of the downstream side, thereby forming a high quality image.

Therefore, the image forming device in accordance with the present invention has at least any of the foregoing arrangements for preventing occurrence of the back-transfer phenomenon, and it very preferably has an arrangement including one or more chromatic color image forming stations for forming a chromatic toner image and a single black image forming station for forming a black toner image as the plurality of image forming stations, and in which an intermediate transfer belt is suspended in a horizontal direction in the main body of the device, wherein the chromatic color image forming stations are disposed side by side on one side of the intermediate transfer belt, and the black image forming station is independently disposed on the other side of the intermediate transfer belt and on the most downstream side of all the image forming stations.

With this arrangement, it is possible to prevent increase in size of the entire device, to increase the size of the image forming station of Bk which is frequently used in image formation to adapt to large counts of monochromatic (black and white) image formation and to independently dispose the single image forming station of Bk, and therefore to increase the first copying speed of monochromatic (black and white) image formation which is frequently used in image formation, and to prevent occurrence of the back-transfer phenomenon of toner to efficiently obtain a color image with superior color reproducibility, thereby obtaining a small color image forming device with superior image quality and fast image forming speed.

That is, the color image forming device according to the present invention is arranged to include a plurality of image forming stations for forming and transferring toner images onto the intermediate transfer belt, which are disposed side by side along the transport or moving direction of the intermediate transfer belt so as to allow the plurality of toner images to be successively transferred one over another with respect to the intermediate transfer belt, wherein assuming that a toner image to be first transferred onto the intermediate transfer belt is a preceding toner image, and a toner image to be transferred after the preceding toner image is a later toner image, when at least the preceding toner image includes improperly charged toner, a control is performed to reduce chargeability of the later toner image when transferring the later toner image.

Further, in the color image forming device according to the present invention, when the preceding toner image does not include improperly charged toner, a control may be performed to improve chargeability of the later toner image when transferring the later toner image.

In any of the foregoing arrangement, when the image forming stations are in the tandem disposition, the chargeability of the later toner image is changed when transferring the later toner image by the image forming station of the downstream side. Further, when there is no improperly charged toner, the chargeability of the later toner image at the time of transfer is improved to make the toner image to be attracted to the intermediate transfer belt more easily. As a result, it is possible to effectively prevent occurrence of the back-transfer or re-transfer phenomenon.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 2(*b*) is a schematic cross sectional view showing a structure of an image forming station dealing with a Bk color, which is included in the image forming section of the color image forming device of FIG. 1.

FIG. 4(*b*) is a schematic cross sectional view showing a structure of an image forming station dealing with a Bk color, which is included in the image forming section of the color image forming device of FIG. 3.

DESCRIPTION OF THE EMBODIMENTS

[First Embodiment]

The following will explain one embodiment of the present invention with reference to drawings. Note that, the present invention is not limited thereto.

A color image forming device of the present embodiment is a semi-tandem type in which a plurality of plural-color image forming stations (toner image forming means) are disposed in tandem with one another (side by side) on a plane of one side of an intermediate transfer belt, while a black (Bk) image forming station is formed on a plane of another side of the intermediate transfer belt, and on a position which is a most downstream side of all the toner image forming stations, thus (1) suppressing a whole device to become larger, (2) increasing the size of the image forming station of Bk which is more frequently employed in image formation, and (3) increasing the first copying speed of monochromatic (black and white) image formation which is frequently used in image formation.

Further, the color image forming device of the present embodiment, in the foregoing arrangement in which the plurality of the image forming stations are disposed in tandem with one another, controls a developing or transfer process in developing or transferring an electrostatic latent image by toner, thereby (4) efficiently forming a color image by suppressing a back-transfer phenomenon and improving color reproducibility.

Figure 1:
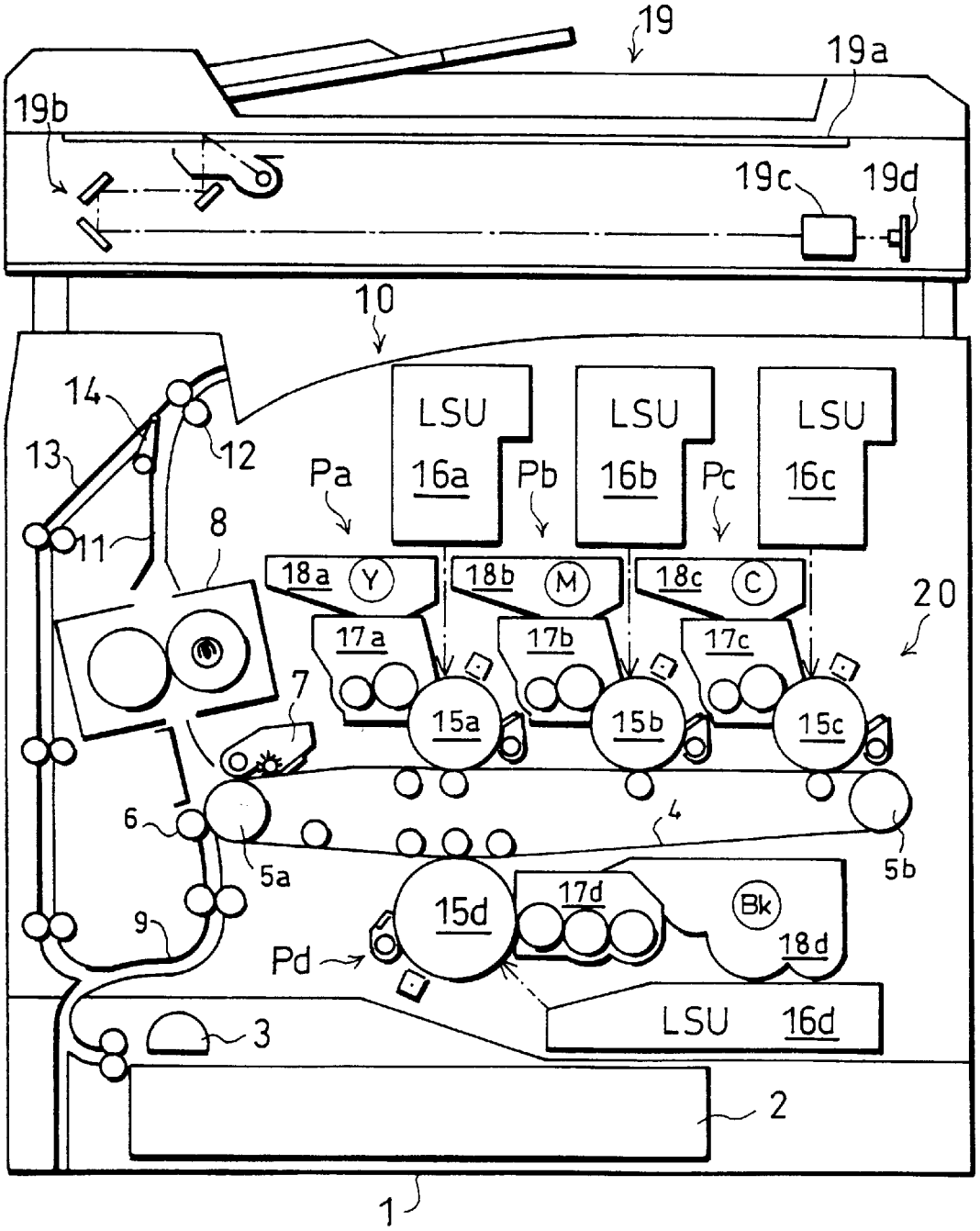
FIG. 1 is a cross sectional view showing a schematic structure of a color image forming device according to one embodiment of the present invention.

The following will explain an image forming device according to the present embodiment. First, as shown in FIG. 1, the image forming device according to the present embodiment is made up at least of a main body of the device ("device main body", hereinafter) 1 and a document reading device 19 (image reading means, scanner unit), and in the device main body 1 is provided paper feeding means. The paper feeding means is made up at least of a sheet feeder cassette (recording medium storing means) 2 and a feeder roller (transport roller) 3, which are integrally disposed on a lowest part of the device main body 1.

The document reading device 19 includes a document table 19*a,* a document scanning body 19*b,* an optical lens 19*c* and a CCD line sensor 19*d.* The document table 19*a* is to have a document placed on its surface, and underneath the document table 19*a* is provided the document scanning body 19*b* which is movable.

Maintaining a constant distance with respect to a lower surface of the document table 19*a,* the document scanning body 19*b* moves to and fro in a horizontal direction at a predetermined scanning speed, and it exposes light on a surface of a document placed on the document table 19*a* so as to reflect a reflected light image from the document toward the optical lens 19*c.* Note that, a dot-dash line in the document reading device 19 of FIG. 1 refers to a reflecting path of the reflected light image.

The optical lens 19*c* reduces the size of the reflected light image from the document, which was reflected by the document scanning body 19*b,* and focuses it on the CCD line sensor 19*d.* Image data which have been converted to an electric signal by the CCD line sensor 19*d* are outputted to an image processing section (not shown) in which predetermined image processing is applied thereto, so as to be used in image formation discussed below.

Note that, though not shown, in the image forming device of the present embodiment, it is arranged that an image data are inputted, for example, from a terminal device which is externally connected, such as a personal computer. The image data is also utilized in image formation by being outputted by the image processing section, as required.

In the sheet feeder cassette 2 is stored sheets of recording paper which is the recording medium. Further, the feeder roller 3 is used to feed a sheet of paper at once from the sheet feeder cassette 2, and it is disposed in a position connecting a recording paper transport path 9 (discussed later) and the sheet feeder cassette 2. The sheet feeder cassette 2 is detachable from the device main body 1.

The device main body 1 includes: image forming stations (toner image forming means) Pa, Pb, Pc and Pd; an intermediate transfer belt (intermediate transfer means) 4; a transfer roller (transfer means or a transfer pole) 6; a cleaning device (cleaning means) 7; a fixing device (fixing means) 8; a recording paper transport path (transport path) 9; a discharge tray (discharging section) 10; a paper discharge path 11; a discharge roller 12; a re-transport path 13; and a switch gate 14.

Note that, in the present embodiment, an image forming section (image forming means) 20 is an arrangement including the image forming stations Pa through Pd and the intermediate transfer belt 4.

The intermediate transfer belt 4 is used to tentatively transmit a toner image of each color, which is formed by the image forming stations Pa through Pd so as to form a color image having all colors superimposed one over another, and two suspension rollers 5*a* and 5*b* suspend the intermediate transfer belt 4 in a horizontal direction, in an upper part of the sheet feeder cassette 2. The suspension roller 5*a* is disposed so as to oppose to the transfer roller 6 while being connected with the recording paper transport path 9. The suspension roller 5*b* is disposed in a position opposing to the suspension roller 5*a* via the image forming stations Pa through Pd in between. At least either one of the suspension rollers 5*a* and 5*b* rotates itself so as to drive the intermediate transfer belt 4 by rotation.

The image forming stations Pa through Pd are the toner forming means for forming toner images, each of which, as discussed below, forms a toner image of a different color. Particularly, the image forming stations Pa, Pb and Pc are provided on a side of one plane (an upper plane in FIG. 1) on a side of an upstream in a rotating direction of the intermediate transfer belt 4. In addition, the image forming station Pd is provided on a side of another plane (a lower plane in FIG. 1) on a side of a downstream in a rotating direction of the intermediate transfer belt 4, i.e., in a position between the sheet feeder cassette 2 and intermediate transfer belt 4.

The transfer roller 6 transfers a toner image formed by the image forming section 20, i.e., formed on the intermediate transfer belt 4, to a sheet of the recording paper transported from the recording paper transport path. This transfer roller 6 is disposed in a position opposing to the suspension roller 5*a* which is deposited between the image forming station Pa and the image forming station Pd. Note that, a position where the transfer roller 6 and the suspension roller 5*a* oppose each other is a transfer position (or a transfer portion).

The cleaning device 7 cleans the residual toner on the intermediate transfer belt 4, and in the present embodiment, for example, it includes a cleaning blade for scraping the residual toner off a surface of the intermediate transfer belt 4 by pressing against the surface thereof. The cleaning device 7, in the present embodiment, is disposed between the suspension roller 5*a* and the image forming station Pa.

Thus, in the present embodiment, around the intermediate transfer belt 4 which is disposed in a substantially horizontal direction are disposed the three image forming stations Pa, Pb and Pc in this order from the side of the upstream in the rotating direction of the intermediate transfer belt 4, and via an edge portion on a side of the suspension roller 5*b* are disposed the image forming station Pd, transfer roller 6 (opposing to the suspension roller 5*a*) and cleaning device 7 in this order.

The fixing device 8 fixes the toner image, which was transmitted from the recording paper transport path 9 and transferred onto the recording paper by the transfer roller 6, on the recording paper. The recording paper transport path 9 transports the recording paper from the sheet feeder cassette 2 to the fixing device 8 via the transfer roller 6. In the present embodiment, since the sheet feeder cassette 2 is disposed on a lower part of the device main body 1, and the image forming section 20 and transfer roller 6 are disposed thereon, the recording paper transport path 9 is disposed inside the device main body 1 from a lower side to an upper side in the substantially horizontal direction. Therefore, the fixing device 8 is disposed above the transfer roller 6, i.e., on an upper end of the recording paper transport path 9.

The discharge tray 10 is disposed in a position which is in a most upper part of the device main body 1 (on a upper side of the device main body 1) and beneath the document reading device 19. This discharge tray 10 includes the paper discharge path 11 and discharge roller 12 which are disposed above the fixing device 8. The recording paper on which the toner image was fixed by the fixing device 8 is discharged by the discharge roller 12 into the discharge tray 10 via the paper discharge path 11.

As shown in FIG. 1, the discharge tray 10 which is disposed in the most upper part of the device main body 1 takes a position substantially parallel to the sheet feeder cassette 2 having the two-dimensional expansion in the same manner, and to the intermediate transfer belt 4 being suspended in the horizontal direction. That is, it is arranged that these three members in a shape of a substantially flat plate are all superimposed one over another, increase in the size of the device main body 1 can largely be suppressed.

The discharge roller 12 is capable of reverse rotation, and not only the paper discharge path 11 but also the re-transport path 13 are connected to a side of an upstream of the discharge roller 12. On a connection between the paper discharge path 11 and re-transport path 13, in other word, on a branch point of these two paths, the switch gate 14 is disposed.

The recording paper which already passed through the fixing device 8, i.e., the recording paper on one surface of which an image was formed can be led into the re-transport path 13 by reverse rotation of the discharge roller 12 and switching of the switch gate 14, thereby being re-transported to the transfer roller 6 again by the re-transport path 13, then, the toner image is transferred again.

Thus, in the present embodiment, the recording paper transport path 9, paper discharge path 11 and re-transport path 13 are formed inside the device main body 1 in a substantially vertical direction.

Next, the following will explain the image forming stations Pa through Pd. The image forming station Pa is to form a toner image of yellow (hereinafter referred to as "Y"), the image forming station Pb is to form a toner image of magenta ("M", hereinafter), the image forming station Pc is to form a toner image of cyan ("C", hereinafter), and the image forming station Pd is to form a toner image of black ("Bk", hereinafter).

Thus, the image forming stations Pa through Pc for forming the toner images of the respective colors of Y, M and C are chromatic color toner image forming means for forming a chromatic color toner image, while the image forming station Pd for forming a Bk toner image is black toner image forming means. Further, basically, in the image forming device according to the present invention, only one image forming station Pd is provided as the black toner image forming means.

Figure 2:
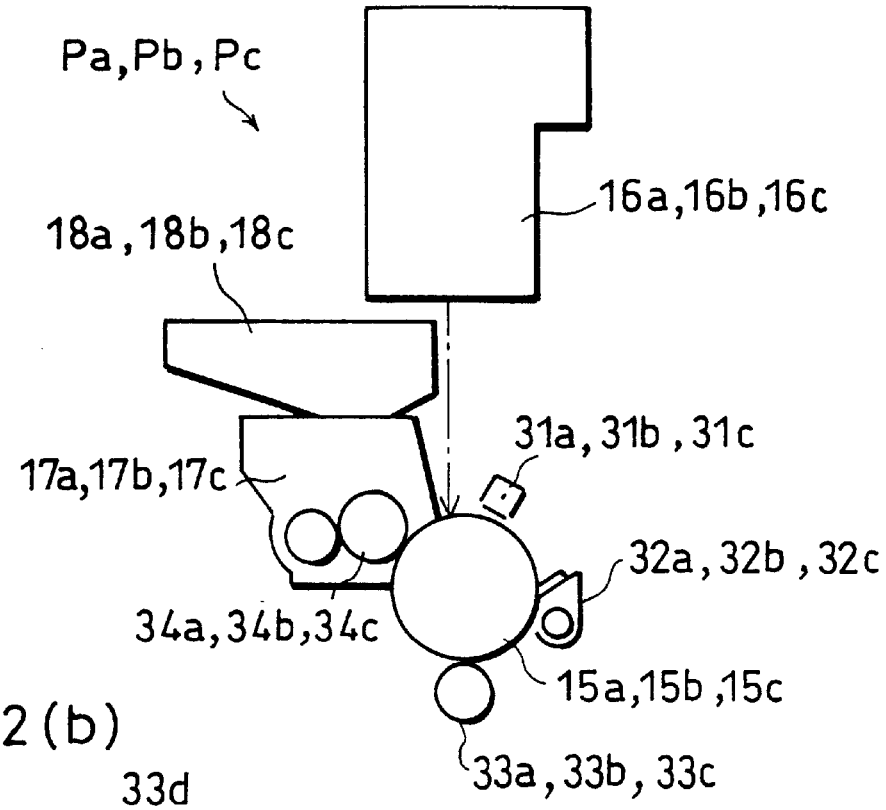
FIG. 2(*a*) is a schematic cross sectional view showing a structure of an image forming station dealing with each color of Y, M or C, which is included in an image forming section of the color image forming device of FIG. 1.
Figure 2:
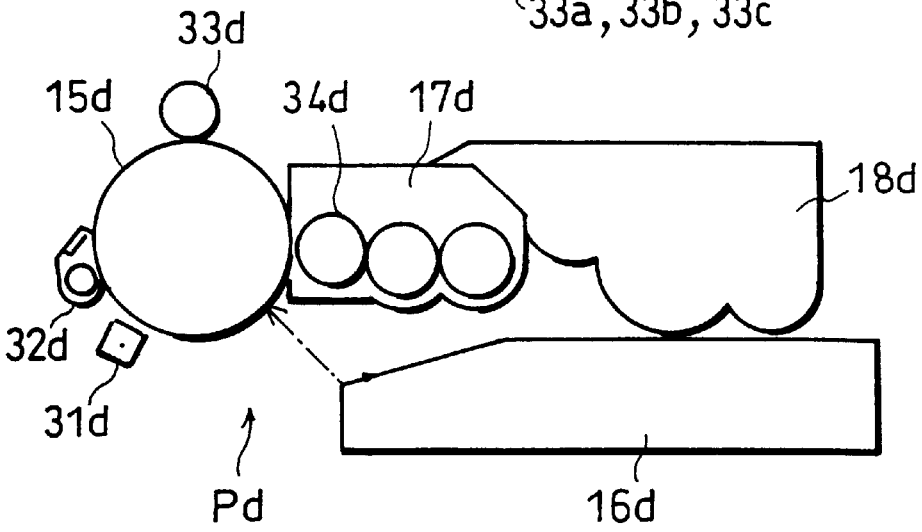

As shown in FIG. 2(*a*), the image forming stations Pa, Pb and Pc have substantially the same arrangement. More specifically, the arrangement is such that the image forming station Pa, Pb or Pc includes: a photoreceptor drum (photoreceptor or image carrier) 15*a,* 15*b* or 15*c*; an LSU (Laser scan unit) 16*a,* 16*b* or 16*c;* a developing device (developing means) 17*a,* 17*b* or 17*c;* a charger 31*a,* 31*b* or 31*c*; a cleaning device 32*a,* 32*b* or 32*c;* and an intermediate transfer roller 33*a,* 33*b* or 33*c*. Of course, another arrangement can be adopted. Further, in FIG. 2(*a*), the intermediate transfer belt 4 is omitted for ease of explanation.

The photoreceptor drum 15*a,* 15*b* or 15*c* carries an electrostatic latent image on a surface thereof by exposure. The LSU 16*a,* 16*b* or 16*c* is exposing means for exposing the photoreceptor drum 15*a,* 15*b* or 15*c* so as to form the electrostatic latent image on the surface thereof (drum surface). The developing device 17*a,* 17*b* or 17*c* develops the electrostatic latent image on the drum surface into a toner image.

The developing device 17*a,* 17*b* or 17*c* employs one-component developer (toner), and on an upper part thereof are provided a developer tank 18*a,* 18*b* or 18*c* for supplying developer (color toner) having each color of yellow (Y), magenta (M) or cyan (c) to the developing device 17*a,* 17*b* or 17*c*. In addition, inside a casing of the developing device 17*a,* 17*b* or 17*c* is provided a developing roller 34*a,* 34*b* or 34*c* for supplying the developer to the photoreceptor drum 15*a,* 15*b* or 15*c,* in such a manner that the developing roller 34*a,* 34*b* or 34*c* faces the drum surface.

The charger 31*a*, 31*b* or 31*c* charges a surface of the photoreceptor drum yet to be exposed 15*a,* 15*b* or 15*c* to a predetermined voltage. The cleaning device 32*a,* 32*b* or 32*c* removes (cleans) the residual toner on the drum surface after the toner image on the drum surface was transferred onto the surface of the intermediate transfer belt 4.

The intermediate transfer roller 33*a,* 33*b* or 33*c* transfers the toner image formed on the drum surface of the photoreceptor drum 15*a,* 15*b* or 15*c* to the surface of the intermediate transfer belt 4. Here, in the present invention, an intermediate transfer roller 33*d* provided in the image forming station Pd which is discussed later is to transfer a toner image to the intermediate transfer belt 4, and has an arrangement different from the transfer roller 6. Therefore, in order to make a clear distinction between the two transfer means, the intermediate transfer rollers 33*a* through 33*d* are referred to as "intermediate transfer means", while referring to the transfer roller 6 for finally transferring the toner image on the intermediate transfer belt 4 to a sheet of the recording paper as "final transfer means", in the present embodiment.

As shown in FIGS. 1 and 2(*a*), in the image forming stations Pa, Pb or Pc, in a periphery of, and in a rotating direction of, the photoreceptor drum 15*a,* 15*b* or 15*c,* the charger 31*a,* 31*b* or 31*c,* the LSU 16*a,* 16*b* or 16*c,* the developing device 17*a,* 17*b* or 17*c* (including the developer tank 18*a,* 18*b* or 18*c*), the intermediate transfer belt 4 (not shown in FIG. 2(*a*)) and the cleaning device 32*a,* 32*b* or 32*c* are provided in this order.

Further, as far as a positional relationship among the LSU 16*a,* 16*b* or 16*c,* the developing device 17*a,* 17*b* or 17*c* and the photoreceptor drum 15*a,* 15*b* or 15*c* is concerned, the LSU 16*a,* 16*b* or 16*c* takes a position in a most upper part, and the photoreceptor drum 15*a,* 15*b* or 15*c* in a lowest part, and the developing device 17*a,* 17*b* or 17*c* is sandwiched between the LSU 16*a,* 16*b* or 16*c* and the photoreceptor drum 15*a,* 15*b* or 15*c,* in the periphery of the photoreceptor drum 15*a,* 15*b* or 15*c,* so as to face the drum surface.

Namely, the image forming stations Pa, Pb and Pc, in order to enable each of them to be disposed with tandem disposition (side by side), have a longitudinal shape with an inclination to extend one-dimensionally from a position to face the intermediate transfer belt 4 with respect to the position on which the LSU 16*a,* 16*b* and 16*c* are provided (with respect to a vertical direction or a direction of height in the device main body 1).

As shown in FIG. 2(*b*), the image forming station Pd includes: a photoreceptor drum 15*d* having a larger width than that of the photoreceptor drum 15*a,* 15*b* or 15*c* of the image forming station Pa, Pb or Pc; an LSU 16*d* which is exposing means for exposing the photoreceptor drum 15*d* so as to form an electrostatic latent image on a drum surface thereof; a developing device 17*d* for developing the electrostatic latent image of the photoreceptor drum 15*d* into a toner image; a charger 31*d* for charging a surface of the photoreceptor drum 15*d;* a cleaning device 32*d* for removing residual toner on the drum surface after development; and an intermediate transfer roller 33*d* for transferring the toner image formed on the drum surface of the photoreceptor drum 15*d* to a surface of the intermediate transfer belt 4.

The developing device 17*d* employs two-component developer, i.e., developer made up of toner and carrier. Therefore, on a top portion thereof is provided the developer tank 18*d* for supplying black (Bk) developer (toner) to the developing device 17*d.* Furthermore, inside a casing of the developing device 17*d,* a developing roller 34*d* for supplying the developer to the photoreceptor drum 15*d* is disposed so as to face the drum surface of the photoreceptor drum 15*d.*

As shown in FIGS. 1 and 2(*b*), in the image forming station Pd, in a periphery of, and in a rotating direction of, the photoreceptor drum 15*d,* the charger 31*d,* the LSU 16*d,* the developing device 17*d,* the intermediate transfer belt 4 (not shown in FIG. 2(*b*)) and the cleaning device 32*d* are disposed in this order, in the same manner as the case of the image forming station Pa, Pb or Pc.

However, as shown in FIG. 1, it is different from the case of the image forming station Pa, Pb or Pc that the image forming station Pd has a form of a substantially flat plate with a two-dimensional expansion. More specifically, the photoreceptor drum 15*d* is disposed on a side of the feeder roller 3, and the developing device 17*d* is disposed next to the photoreceptor drum 15*d* along the intermediate transfer belt 4, and further, the developer tank 18*d* is disposed on a side of the developing device 17*d,* thereby forming the image forming station Pd to have a compressed form.

Namely, the image forming station Pd has the form of the substantially flat plate by disposing the photoreceptor drum 15*d,* developing device 17*d* and developer tank 18*d* in this order which are disposed side by side in one direction, while having the developer tank 18*d* which is formed in a shape of a large flat plate extending in a horizontal direction from this side to that side, and from left to right in FIG. 1 or 2(*b*).

Thus, the Bk image forming station Pd takes a form which greatly coincides a form of the intermediate transfer belt 4 in a suspending direction. Consequently, the image forming station Pd can be stored, almost leaving no space, so as to almost match the shape of the substantially flat plate of a spacing between the intermediate transfer belt 4 and sheet feeder cassette 2, thus greatly utilizing space inside the device main body. Moreover, forming the developer tank 18*d* to have an expansion in the state of the flat plate results in increasing a storing capacity of the developer, thereby storing toner of a quantity which is suitable for forming a monochromatic image frequently used in image formation.

The image forming section 20 of the present invention has an arrangement in which the image forming stations Pa, Pb and Pc thus having the substantially lengthwise form are disposed in tandem, while the image forming station Pd having the form of the substantially flat plate is disposed so as to face the respective image forming stations Pa, Pb and Pc disposed in tandem, and further, between them is suspended the intermediate transferring belt 4. The image forming station Pd having the two-dimensional expansion, in particular, is disposed so that a direction of the two-dimensional expansion coincides with the suspending direction of the intermediate transferring belt 4.

Thus, it is unnecessary that the four image forming stations be juxtaposed, thereby making it possible to (1) suppress increase in the size of a whole device, and, (2) since the image forming station Pd of Bk which is more frequently used in image-forming is virtually disposed alone, the image forming station Pd is increased in size so as to enable it to form a large quantity of the monochromatic (black and white) images, and, as it will be discussed later, (3) a faster first copying speed of forming the monochromatic (black and white) image which is frequently used in image-forming, and also a faster image-forming speed of the monochromatic image can be realized.

Furthermore, in the present invention, as it will be discussed later, (4) in order to prevent a back-transfer phenomenon in the respective image forming stations Pa through Pd, a transferring voltage in the intermediate transferring rollers 33*a* through 33*d*, a developing voltage in the developing rollers 34*a* through 34*d,* and a charging quantity and particle size of toner stored in the developer tank 18*a* through 18*d* are set to be changed at a predetermined rate, respectively.

Next, the following will explain an image-forming operation in the foregoing semi-tandem type color image-forming device according to the present embodiment. The present invention is capable of not only attaining prompter color image-forming, but also attaining a faster image-forming of a monochromatic (black and white) image which is more frequently used in image-forming, and therefore in the following explanation are explained (I) formation of a color image and (II) formation of a monochromatic image, respectively.

(I) Formation of a Color Image

First, either image data obtained by performing image processing on a document image which was read out by the document reading device 19 or image data inputted from an externally connected terminal device is outputted to the LSU 16*a* through 16*d* of the image forming stations Pa through Pd, respectively. Since the image data are provided for respective colors of Y, M, C and Bk, image data corresponding to Y is outputted to the image forming station Pa, image data M corresponding to M to the image forming station Pb, image data corresponding to C to the image forming station Pc, and image data corresponding to Bk to the image forming station Pd, respectively.

In the LSU 16*a* through 16*d,* in accordance with normal image forming process, electrostatic latent images corresponding to the respective colors are formed on the drum surfaces of the photoreceptor drums 15*a* through 15*d.* Namely, the LSU 16*a* through 16*d* write the electrostatic latent images corresponding to the respective colors of Y, M, C and Bk on the drum surfaces of the photoreceptor drums 15*a* through 15*d* based on the image data (picture signals) of the respective colors of Y, M, C and Bk.

More specifically, with respect to the drum surfaces of the photoreceptor drums 15*a* through 15*d* which are uniformly charged by the chargers 32*a* through 31*d,* laser beams based on the image data corresponding to the respective colors emerge from the LSU 16*a* through 16*d* so as to scan the drum surfaces. Here, main scanning by means of the laser beams, and sub scanning by rotation of the photoreceptor drums 15*a* through 15*d* form respective electrostatic latent images corresponding to the respective colors on the drum surfaces.

The electrostatic latent images corresponding to the respective colors are developed by the developing devices 17*a* through 17*d,* using the developer of the respective colors, and toner images of the respective colors are formed on the surfaces of the photoreceptor drums 15*a* through 15*d,* respectively. These toner images are superimposed one over another on the intermediate transfer belt 4.

More specifically, first, in the image forming station Pa which is located on a side of a top of an upstream in a rotating direction of the intermediate transfer belt 4, a toner image of Y is formed, and transferred onto a surface of the intermediate transfer belt 4. Next, following the rotation of the intermediate transfer belt 4, the surface which faced the image forming station Pa shifts to the next image forming station Pb. Then, in the image forming station Pb, a toner image of M is transferred so that it is superimposed on the Y toner image previously transferred. Likewise, a toner image of C in the image forming station Pc, and a toner image of Bk in the image forming station Pd located in a most downstream are transferred so as to be superimposed on the toner images previously transferred, respectively, thus forming a toner image with multiple colors, i.e., a color image, on the intermediate transfer belt 4.

The color image is transferred by the transfer roller 6 to a sheet of the recording paper which was supplied out of the sheet feeder cassette 2 by the feeder roller 3, and transported between the suspension roller 5 and the transfer roller 6 via the recording paper transport path 9.

Thereafter, the recording paper having the color image transferred thereon is transported to the fixing device 8 so that the color image is fixed on the recording paper. Then, passing through the paper discharge path 11, the recording paper is discharged into the discharge tray 10 by the discharge roller 12, thus completing a series of the color image forming process.

Further, in the case of forming an image on both sides of the paper, first, while holding by the discharge roller 12 a rear edge of the recording paper transported through the paper discharge path 11, rotation of the discharge roller 12 is stopped. Until then, the discharge roller 12 rotates in a normal direction of rotation, i.e., in such a direction as to discharge the recording paper into the discharge tray 10. Then, switching the switch gate 14, the discharge roller 12 rotates into a reverse direction of rotation, thereby transporting the recording paper in the reverse direction, out of the discharge tray 10 to the re-transport path 13.

The recording paper on one side of which the color image was fixed is re-transported to a transfer section, in such a state that it is turned upside down by being transported through the re-transport path 13, again, via the recording paper transport path 9. In the transfer section, the transfer roller 6 transfers the color image to the other side of the recording paper, and the fixing device 8 fixes the color image before the recording paper is discharged into the discharge tray 10, thus completing image formation on both sides of the recording paper.

Note that, the cleaning device 7 which is, when viewed from the transfer section, provided on a side of an upstream from the image forming station Pa, or on a side of a downstream in the rotational direction of the intermediate transfer belt 4, removes residual toner on the intermediate transfer belt 4. The same applies to the formation of a monochromatic image which will be discussed below. Consequently, after one rotation of the intermediate transfer belt 4, no residual toner remains on the surface thereof, thus making it possible to make a continuous transition to the next image forming process.

(II) Formation of a Monochromatic Image

First, image data obtained by performing image processing on document image data which were read out by the document reading device 19, or image data inputted from an externally connected terminal device is outputted to the LSU 16*d* in the Bk image forming station Pd.

In the LSU 16*d*, in accordance with a normal image forming process, an electrostatic latent image corresponding to Bk is formed on a drum surface of the photoreceptor drum 15*d*. Namely, the LSU 16*d* writes the electrostatic latent image corresponding to Bk on the drum surface of the photoreceptor drum 15*d* based on image data (picture signals) of Bk. More specifically, with respect to the drum surface of the photoreceptor drum 15*d* which is uniformly charged by the charger 31*d*, a laser beam based on the image data corresponding to Bk emerges from the LSU 16*d* so as to scan the drum surface. Here, main scanning by means of the laser beam, and sub scanning by rotation of the photoreceptor drum 15*d* form an electrostatic latent image corresponding to Bk on the drum surface.

The electrostatic latent image corresponding to Bk is developed by the developing device 17*d*, using the developer (toner) of Bk, and a toner image of Bk is formed on the surface of the photoreceptor drum 15*d*. This toner image is transferred onto the intermediate transfer belt 4.

The Bk toner image is transferred by the transfer roller 6 to a sheet of the recording paper which was supplied out of the sheet feeder cassette 2 by the feeder roller 3, and transported between the suspension roller 5 and the transfer roller 6 via the recording paper transport path 9, thus forming a monochromatic image.

Thereafter, the recording paper having the monochromatic image transferred thereon is transported to the fixing device 8 so that the monochromatic image is fixed on the recording paper. Then, passing through the paper discharge path 11, the recording paper is discharged into the discharge tray 10 by the discharge roller 12, thus completing a series of the monochromatic image forming process.

Note that, in the case of forming the monochromatic image on both sides of the recording paper, as in the foregoing color image forming operation, it is attained by re-transporting the recording paper to the transfer section via the re-transport path 13.

In this manner, in the semi-tandem type color image forming device according to the present invention, in the image forming section 20, the Bk image forming station Pd is disposed on a location which is on the most downstream side of the intermediate transfer belt 4, or which is closest to the transfer section where the transfer roller 6 is disposed. By thus independently providing the Bk image forming station Pd practically, the first copying speed of monochromatic image formation which is frequently used in image formation can be increased.

Further, in the Bk image forming station Pd, on a side without the feeder roller 3 is disposed the developing device 17*d* and developer tank 18*d* of Bk. That is, when there exists a member such as the feeder roller 3 as a paper feeding member of the sheet feeder cassette 2, which projects out of the two-dimensional expansion into a three-dimensional direction, in the space taking the form of the substantially flat plate between the intermediate transfer belt 4 and the sheet feeder cassette 2 having the two-dimensional expansion which is usually disposed in the lower part of the device main body 1, the image forming station Pd is provided in the space having the form of the substantially flat plate by providing the photoreceptor drum 15*d* in a vicinity of the projecting member (feeder roller 3).

Thus, the photoreceptor drum 15*d* which has a relatively small capacity is disposed on a side of the projecting member, while the developer tank 18*d* which requires a larger capacity is disposed in a position which is opposite to the projecting member, thereby making good use of the space having the form of the substantially flat plate, while increasing the capacity of the developer tank 18*d* in the image forming station Pd of Bk which is more frequently used in image formation, without increasing the size of the whole device in the direction of height.

Moreover, in the Bk image forming station Pd, the width of the photoreceptor drum 15*d* is made larger than those of the photoreceptor drums 15*a*, 15*b* and 15*c* in the image forming stations Pa, Pb and Pc of the other colors (Y, M and C), thereby suppressing reduction in a film of a photosensitive film due to variation with time, and realizing a longer life cycle.

Consequently, the photoreceptor drum 15*d* can be used in a longer period of time than the other photoreceptor drums 15*a* through 15*c*. Namely, as far as a sum total of the counts of image formation by the time a photoreceptor drum becomes useless is concerned, it is larger in the case of the photoreceptor drum 15*d* than the case of the other photoreceptor drums 15*a* through 15*c*, thus realizing a longer period of time for use of a photoreceptor drum before replacement (reducing the number of times for replacement), and increasing ease of use.

Furthermore, only the Bk image forming station Pd is provided in the space having the form of the substantially flat plate between the intermediate transfer belt 4 and the sheet feeder cassette 2, thus making good use of the space having the form of the substantially flat plate. Such space having the form of the substantially flat plate has a sufficient two-dimensional expansion (the size in the horizontal direction) even though it lacks a three-dimensional expansion (the size of the device main body 1 in the direction of height).

Accordingly, by forming the developing device 17*d* and developer tank 18*d* to have a form of a flat plate, the developing device 17*d* and developer tank 18*d* can be increased in size, thus making it possible to use two-component developer made up of toner and carrier as main components, as Bk developer in the developing device 17*d*. As a result, a longer life cycle thereof can be realized, while realizing faster image formation of a Bk image.

On the other hand, the developing devices 17*a*, 17*b* and 17*c* of the image forming stations Pa, Pb and Pc of Y, M, C, respectively, use one-component developer including toner as a main component. This makes it possible to reduce the sizes of the image forming stations Pa, Pb and Pc, thus preventing increase in size of the device main body 1 in the horizontal direction.

Additionally, since the image forming station Pd of Bk in effect is provided independently, when forming a monochromatic image, a process speed of the image forming station Pd (rotational speed of the photoreceptor drum 15*d*) can be increased, thereby further increasing the first copying speed of monochromatic image formation while increasing the speed of monochromatic image formation.

Furthermore, the fixing device 8 which is to reach a high temperature is disposed in a position above the transfer roller 6 which is disposed to face the suspension roller 5*a* of the intermediate transfer belt 4, thus making it possible to increase a spacing between the intermediate transfer belt 4 and the fixing device 8, thereby preventing fusion of toner into the intermediate transfer belt 4 due to an influence of the heat of the fixing device 8, while preventing decay of a blade of the cleaning device 7.

Note that, in the present embodiment, a color image which is made up of four colors including three chromatic colors of Y, M and C, and Bk is formed. This is not particularly limited as long as the present invention has an arrangement having the image forming stations for forming toner images of the chromatic colors on one side of the intermediate transfer belt has the tandem disposition, while disposing the image forming station of Bk which is frequently used in image formation, alone and on the other side of the intermediate transfer belt.

It should be noted that there exists an arrangement where a color image is formed by employing toner of a white color, and therefore, the image forming stations of the tandem disposition which are disposed on one side of the intermediate transfer belt are only required to form a toner image of the white color and the chromatic colors, but not that of the black color.

Thus, the image forming device according to the present invention includes a plurality of toner image forming means for respectively forming toner images of different colors, and an intermediate transfer belt on which the toner images which are respectively formed by the plurality of toner image forming means are successively transferred one over another, the image forming device further including, as the plurality of toner image forming means for forming a toner image having a chromatic color, and only one black toner image forming means for forming a toner image having a black color, and the intermediate transfer belt being suspended in a shape of a substantially flat plate by at least two suspension rollers inside a main body, and the chromatic color toner image forming means being disposed on one side of the suspended intermediate transfer belt, and the black toner image forming means being disposed on the other side of the intermediate transfer belt, alone and on a most downstream side of all the toner image forming means.

With the foregoing arrangement, with respect to the chromatic color toner image forming means for forming the color image, the black toner image forming means is practically provided independently. Therefore, the plurality of toner image forming means do not have the tandem disposition as a whole, thereby suppressing increase in size of the entire device, while increasing the size of the black toner image forming means which is frequently used in image formation. Moreover, when forming a monochromatic image, it is possible to increase the process speed of the black toner image forming means, thereby further increasing the first copying speed of monochromatic image formation, while increasing the speed of monochromatic image formation.

In the image forming device according to the present invention, in addition to the foregoing arrangement, it is preferable that the black toner image forming means is disposed to have the shape of the substantially flat plate extending two-dimensionally, and the direction of the two-dimensional extension is set to be along the suspending direction of the intermediate transfer belt.

With the foregoing arrangement, the black toner image forming means itself is formed in the shape of the substantially flat plate, making it possible to have a shape which coincides with the suspending direction of the intermediate transfer belt. Therefore, the black toner image forming means can be disposed along the suspending direction of the intermediate transfer belt, thus making good use of the space inside the device main body.

In the image forming device according to the present invention, in addition to the foregoing arrangement, it is preferable that the black toner image forming means includes an image carrier for carrying an electrostatic latent image, developing means for developing the electrostatic image with toner to form a toner image, and a developer tank for storing the toner, wherein the image carrier, the developing means and the developer tank are disposed side by side in this order in one direction, thereby taking the form of the substantially flat plate.

With the foregoing arrangement, since the developer tank and the developing means can be formed to have an extension in the shape of a flat plate, a storing capacity of toner can be increased, thereby storing a suitable quantity of toner for monochromatic image formation which is frequently used in image formation.

In the image forming device according to the present invention, in addition to the foregoing arrangement, further, it is preferable that, in the device main body, the intermediate transfer belt is suspended in a substantially horizontal direction, and along the suspending direction of the intermediate transfer belt is disposed a recording medium storing section for storing a recording medium to which the toner image is finally transferred, and in the spacing having the shape of the substantially flat plate between the intermediate transfer belt and the recording medium storing section is disposed the black toner image forming means.

With the foregoing arrangement, the black toner image forming means which is disposed alone is disposed in the space having the shape of the substantially flat plate between the intermediate transfer belt and the recording medium storing section, and thereby the black toner image forming means can be stored, leaving substantially no space, thus making good use of the space having the shape of the substantially flat plate inside the device main body.

Particularly, despite lacking a three-dimensional extension (the size of the device main body in the direction of height), this space having the shape of the substantially flat plate has a sufficient two-dimensional extension (the size in the horizontal direction). Consequently, forming the developing means and the developer tank of the black toner image forming means in the shape of the flat plate makes it possible to increase the size of the developing means and the developer tank of the black toner image forming means, and in the developing means, two-component developer including toner and carrier as the main component can be used as the developer of Bk.

In the image forming device according to the present embodiment, in addition to the foregoing arrangement, further, it is preferable to include final transfer means for finally transferring the toner image, which was transferred onto the intermediate transfer belt, to the recording medium, fixing means for fixing the toner image, which was finally transferred, on the recording medium, and a transport path for transporting the recording medium from the recording medium storing section to the fixing means via the final transfer means, wherein the intermediate transfer belt is suspended in a substantially horizontal direction inside the device main body, and the transport path is disposed in a substantially vertical direction inside the device main body, and the recording medium storing section is disposed in a lower part of the device main body.

With the foregoing arrangement, since the fixing means which is to have a high temperature is disposed in a position in an upper direction, a spacing between the intermediate transfer belt and the fixing means can be increased, thereby preventing fusion of toner into the intermediate transfer belt due to an influence of the heat of the fixing means. Further, in the case of providing cleaning means, decay of a blade of the cleaning means due to heat can also be prevented.

In the image forming device according to the present invention, in addition to the foregoing arrangement, further, it is preferable that the recording medium storing section includes a transport roller for transporting the recording medium to the transport path, and the black toner image forming means is disposed in the space having the shape of the substantially flat plate between the intermediate transfer belt and the recording medium storing section in such a manner that an image carrier comes closer to the transport roller.

With the foregoing arrangement, while disposing the image carrier having a relatively small capacity on a side of the transport roller which is a projecting member, the developer tank which requires a larger capacity is disposed on the opposite side to the transport roller which is the projecting roller. Consequently, making good use of the space having the shape of the substantially flat plate, the capacity of the developer tank included in the black toner image forming means which is frequently used in image formation can be increased without increasing the size of the device main body in the direction of height.

In the image forming device according to the present invention, in addition to the foregoing arrangement, it is preferable that the image carriers for carrying the electrostatic latent images, included in the plurality of toner image forming means, have a substantially cylindrical shape, and a diameter of the image carrier included in the black toner image forming means is formed to be larger than those of image carriers included in the chromatic color toner image forming means.

With the foregoing arrangement, since the diameter of the image carrier of the black toner image forming means is large, a longer life cycle can be realized by suppressing reduction in a film of a photosensitive film due to variation with time, thereby realizing a longer period of time for use of an image carrier before replacement (reducing the number of times for replacement), and increasing ease of use in formation of a black toner image which is frequently used in image formation.

In the image forming device according to the present invention, in addition to the foregoing arrangement, it is preferable that the plurality of toner image forming means respectively include exposing means for exposing a surface of the image carrier which carries an electrostatic latent image so as to form the electrostatic latent image, and that a laser scan unit is used as the exposing means.

With the foregoing arrangement, the laser scan unit (LSU) is suitably used in image formation based on digital information, and therefore, in a particular case where the image forming device according to the present invention is a digital color image forming device, a high-quality color image can be formed.

In the image forming device according to the present invention, in addition to the foregoing arrangement, it is preferable that the black toner image forming means uses two-component developer including toner and carrier, and the chromatic color toner image forming means uses one-component developer including toner.

With the foregoing arrangement, since the chromatic color toner image forming means uses one-component developer, the size of the chromatic color toner image forming means can be reduced, thereby suppressing increase in the size of the device main body in the horizontal direction. On the other hand, since the black toner image forming means uses two-component developer, a longer life cycle of the developing means can be realized, while increasing the speed of formation of a black toner image.

Here, in an arrangement of the tandem disposition in a broad sense, which includes a conventionally known tandem type color image forming device and the semi-tandem type color image forming device according to the present invention, i.e., in an arrangement in which an image forming section includes a plurality of toner image forming sections which are disposed side by side along a transport or moving direction of an intermediate transfer medium so as to allow a plurality of toner images to be successively transferred one over another with respect to the transfer medium such as an intermediate transfer medium and a recording medium, a back-transfer phenomenon occurs easily, thereby degrading an image quality of an obtained color image.

Figure 12:
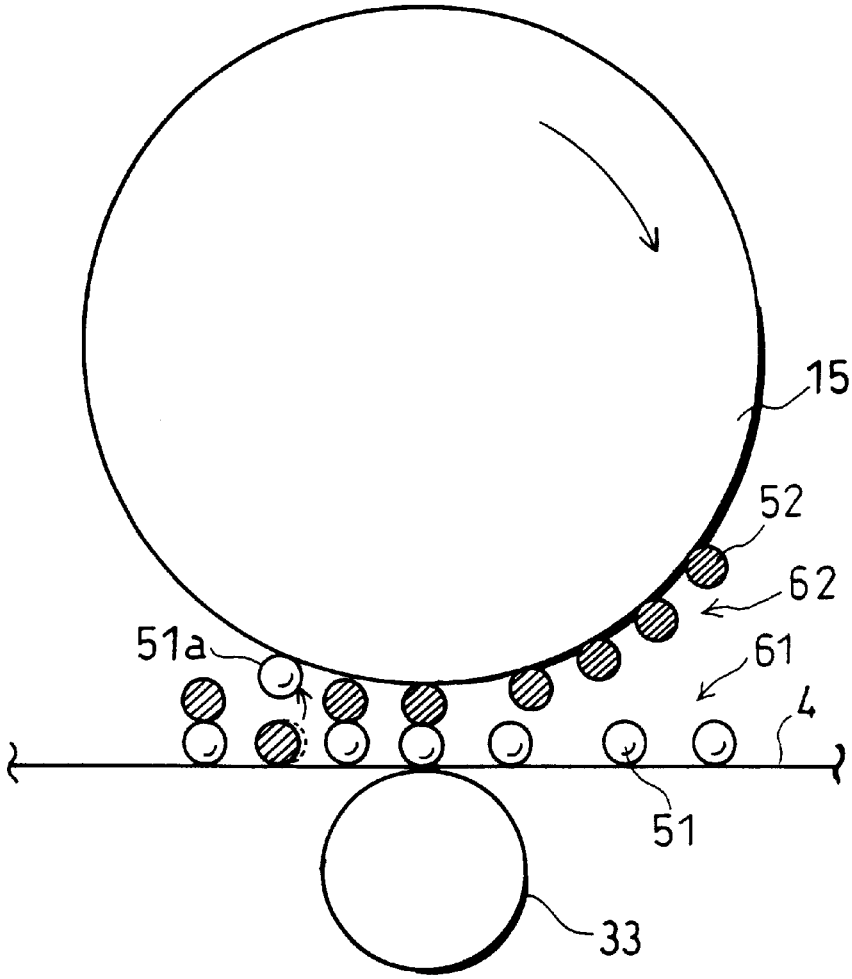
FIG. 12 is an explanatory drawing explaining a back-transfer phenomenon in the case of including electrostatic charge defect toner, which generates in tandem type color image forming devices including the color image forming device of the present invention.

This back-transfer phenomenon is caused by the fact that a toner image on a surface of a photoreceptor which is transferred first includes toner having a weak polarity (weakly charged toner) and toner having a reverse polarity (reversely charged toner). That is, as shown in FIG. 12, when transferring a preceding toner image 61 made up of toner 51 in an image forming station of a preceding stage, and transferring a later toner image 62 made up of toner 52 which is superimposed on the preceding toner image 61 in an image forming station of a later stage, since the transfer charge has the negative polarity with respect to reversely charged toner 51*a*, an addition of a transfer charge with respect to the preceding toner image 61 causes electrostatic attraction force to act from the transfer medium (intermediate transfer belt 4) to a side of the photoreceptor drum 15, thereby causing the reversely charged toner 51*a* to return from a surface of the transfer medium to a surface of the photoreceptor drum 15.

Accordingly, in the present invention, in order to suppress occurrence of the back-transfer phenomenon, in case where the toner image forming means are disposed side by side along the transport or moving direction of the transfer medium, a transfer process or a developing process is controlled so as to reduce the electrostatic attraction which acts on the side of the photoreceptor drum with respect to the reversely charged toner and/or weakly charged toner existing over the photoreceptor drum from an upstream side to a downstream side in the transport or moving direction.

Namely, assuming that a toner image to be first transferred onto the transfer medium is a preceding toner image, and a toner image to be transferred after the preceding toner image is a later toner image, when at least the preceding toner image includes improperly charged toner such as reversely charged toner and weakly charged toner, a control is performed to reduce chargeability of the later toner image when transferring the later toner image.

Note that, a "transfer medium" referred to herein includes, as described above, both of the intermediate transfer medium and the recording medium, and indicates a medium to which a toner image is transferred from toner image forming means. Further, in the following explanation, the description of "an upstream or a downstream in a transport or moving direction of the transfer medium" is simply described as "an upstream or a downstream".

Further, in the present invention, "chargeability of a toner image when transferring it" is defined as either "the susceptibility of toner, which forms a toner image, to be charged", or "a quantity of charge which is given to toner making up a toner image when performing at least either one of a transfer process or a developing process which directly affects the transfer process". Furthermore, "reduction in the chargeability" indicates "resistance of toner to charging" or "reduction in charge which is given to toner".

Specifically, in the present invention, in an image forming device having an arrangement in which image forming stations (toner image forming means) are disposed side by side, in order to efficiently obtain a color image with superior color reproducibility by suppressing a toner back-transfer phenomenon, at least one of the following methods is, or most preferably, all the methods are adopted.

(Method 1) The transfer voltage added to the transfer means of the plurality of image forming stations of the tandem disposition are set to decrease toward the downstream side. In this method, the transfer voltage is adjusted to decrease the quantity of charge applied to toner which forms a later toner image in transfer.

In this method, the transfer voltage of the toner image decrease toward the downstream side. Thus, even when the preceding toner image includes reversely charged toner and/or weakly charged toner, the electrostatic attraction force acting between the reversely charged toner or weakly charged toner and the photoreceptor becomes smaller. As a result, back-transfer of toner from the transfer medium to the surface of the photoreceptor is prevented, thereby preventing occurrence of the back-transfer phenomenon in image forming stations of the downstream side.

Specifically, in the present invention, it is preferable that the transfer voltage is set to decrease toward the downstream side at a certain ratio. Such a ratio is not particularly limited as long as it does not prevent toner transfer, yet, generally, a transfer voltage for efficiently transferring toner is preferably in a range of not less than 1 kV and not more than 2.5 kV.

Thus, in the present invention, the transfer voltage is preferably decreased toward the downstream side within a range of not less than |200| V and not more than |300| V for each decrement. Representing the decrement ratio in percent, using the transfer voltage of the transfer device of the most upstream side as a reference, the transfer voltage is decreased within a range of not less than 10% and not more than 20% for each decrement. Specifically, for example, when the transfer voltage of the transfer device of the most upstream side is −2000 V (−2.0 kV), the transfer voltage is decreased by |300| V for each decrement in order from −1700 V (−1.7 kV), −1400 V (1.4 kV), and −1100 V (−1.1 kV). The decrement ratio in this case is about 15% with the reference transfer voltage of −2000 V of the transfer device of the most upstream side.

Note that, a specific decrement value of the transfer voltage and a decrement ratio of the transfer voltage in percent are derived from separate methods of setting the transfer voltage to decrease toward the downstream side, and thus the specific numerical decrement value does not necessarily coincides with the numerical decrement value of the transfer voltage converted from the percentage value. That is, in the present invention, the way (method) the transfer voltage is decreased is not particularly limited as long as the transfer voltage of the transfer device of the most upstream side and the transfer voltage of the transfer device of the most downstream side are within a range of not less than 1 kV and not more than 2.5 kV in the plurality of image forming stations of the tandem disposition. The same can be said for charged quantity of toner, decrease in developing potential, and increase in particle size of toner, which will be described later.

The following describes a transfer process using the transfer means of the present embodiment as an example. For example, the intermediate transfer rollers 33*a* to 33*d* as shown in FIGS. 2(*a*) and 2(*b*) are, generally, conductive rollers using conductive rubber, or dielectric rollers which additionally include a dielectric layer on the conductive rubber. When transferring a toner image on a transfer medium such as the intermediate transfer belt 4, a voltage is directly applied to the intermediate transfer belt via the intermediate transfer rollers 33*a* to 33*d* having the foregoing arrangement, and toner images are transferred by a generated electric field.

Thus, as a specific method of setting the transfer voltage to decrease toward the downstream side at a certain ratio, it is possible to adopt a method of simply and individually controlling a voltage applied to the transfer means, or a method of changing the composition of the material or coating agent of the transfer means, i.e., a method of suitably selecting the material or composition of the conductive rubber or dielectric layer which directly applies a voltage to the transfer medium.

Note that, in any of the foregoing methods, specific numerical values, and the materials or compositions are not particularly limited as long as they are within the conventional range and the transfer voltage can be varied at a certain ratio.

Further, the "transfer means" referred to herein indicates the transfer means used in the arrangement where toner images are successively transferred one over another with respect to the transfer medium by the plurality of toner image forming means of the tandem (side by side) disposition. Therefore, in the present embodiment, the intermediate transfer rollers (intermediate transfer means ) 33*a* to 33*d* correspond to the "transfer means", while the transfer roller 6 (final transfer means) does not.

Further, in the present invention, even though the image forming station Pd of Bk is provided practically independently, this is just a matter of disposition, and as a whole, the image forming station Pd of Bk can be seen as being disposed continuously with the other chromatic image forming stations Pa through Pc via the intermediate transfer belt 4. That is, in the present invention, the image forming station Pd of Bk can be used independently under some circumstances, and under other circumstances, continuously with the other image forming stations Pa through Pc in a near tandem disposition. Thus, the intermediate transfer roller 33*d* of the image forming station Pd of Bk also corresponds to the "transfer means".

(Method 2) The charged quantity of color developers respectively stored in the developing devices of the plurality of image forming stations of the tandem disposition is set to decrease toward the downstream side. In this method, the chargeability of toner itself for forming a toner image is decreased.

In this method, the charged quantity of developer, i.e., toner is decreased toward the downstream side. This makes it possible to decrease the applied transfer voltage when transferring the later toner image even when the preceding toner image includes reversely charged toner or weakly charged toner, thus reducing the electrostatic attraction force acting between the reversely charged toner or weakly charged toner and the photoreceptor. As a result, back-transfer of toner from the transfer medium to the surface of the photoreceptor is prevented, thereby preventing occurrence of the back-transfer phenomenon in the image forming stations of the downstream side.

Specifically, in the present invention, it is preferable that the charged quantity of toner is set to decrease toward the downstream side at a certain ratio. Such a ratio is not particularly limited as long as it does not prevent development of electrostatic image and toner transfer, yet, generally, the charged quantity of toner is preferably in a range of not less than $|5|$ $\mu$C/g and not more than $|50|$ $\mu$C/g.

Thus, in the present invention, the charged quantity of toner is preferably decreased toward the downstream side within a range of not less than $|3|$ $\mu$C/g and not more than $|10|$ $\mu$C/g for each decrement, and more preferably in a range of not less than $|7|$ $\mu$C/g and not more than $|10|$ $\mu$C/g. Representing the decrement ratio in percent, using the charged quantity of toner of the most upstream side as a reference, the charged quantity of toner is preferably decreased within a range of not less than 10% and not more than 20% for each decrement. Specifically, for example, when the charged quantity of toner of the most upstream side is $-40$ $\mu$C/g, the charged quantity of toner is decreased by $|5|$ $\mu$C/g for each decrement in order from $-35$ $\mu$C/g, $-30$ $\mu$C/g, and $-25$ $\mu$C/g. The decrement ratio in this case is about 12.5% with the reference charged quantity of toner of the most upstream side.

Here, the toner used in the present invention is the same as the conventionally known toner. Namely, the color toner (including black toner) used as the developer of the electrophotographic image forming device is a particulate power which contains, within binder resin, a coloring agent for coloring the toner to have a desired color, a charge controlling agent for adjusting charged quantity of toner, and a fixability improving agent for improving fixability of toner on the recording medium, etc. Further, a fluidizing agent such as inorganic fine particles may be added to the particulate power as required. The method of producing the color toner will be described later.

The binder resin of toner is not particularly limited, and various conventionally known resins can be used. Among these, when obtaining negatively charged toner, polyester resin is preferable in view of frictional electrification series, and styrene/acryl resin is next preferable. On the other hand, when obtaining positively charged toner, styrene/acryl resin or epoxy resin is preferable.

The property of the binder resin is not particularly limited either. For example, in order to have desirable fixability, the flow softening temperature and glass transition temperature are preferably within a conventional range.

The coloring agent of toner is not particularly limited either, and a conventionally known pigment or dye may be adopted. Specifically, as the yellow (Y) pigment, magenta (M) pigment, cyan (C) pigment, and black (Bk) pigment, for example, the following pigments may be suitably used either individually or by a combination of two or more kinds: an yellow pigment such as hansa yellow G, chrome yellow, and benzidine yellow; an yellow/red pigment such as monoazo pigment and diazo pigment; red pigment such as quinacridone and rose bengal; blue pigment such as ultramarine blue, navy blue, and copper phthalocyanine blue; green pigment such as copper phthalocyanine green; and black pigment such as carbon black, titanium black, and iron black. Though no specific examples are given, evidently, conventional dyes can suitably used as well.

The amount of coloring agent added is not particularly limited as long as the toner is colored as desired and the property of the toner does not suffer, and it can be added within a conventional range.

The charge controlling agent of toner (charge controlling agent/CCA) is suitably selected to be negatively charged or positively charged depending on negatively charged toner or positively charged toner is used, respectively.

The negatively charged charge controlling agent includes, for example, but not particularly limited to azo dye containing metal such as Cr, Co, Al, or Fe, salicylic acid metallic compound, alkyl salicylic acid metallic compound, and calixarene compound. Among these, salicylic acid metallic compound and salicylic acid metal complex in particular are preferable. The positively charged charge controlling agent includes, for example, but not particularly limited to nigrosine dye, quaternary ammonium salt compound, triphenylmethane compound, imidazole compound, and polyamine resin. Among these, nigrosine dye and quaternary ammonium salt compound are preferable.

The amount of charge controlling agent is not particularly limited either as long as chargeability of toner is suitably controlled and the property of the toner does not suffer, and it can be added within a conventional range.

The fixability improving agent of toner includes, for example, but not limited to polyolefin wax, paraffin wax, fatty ester or saponification compound thereof, fatty amide compound, and high grade alcohol.

The amount of fixability improving agent added is not particularly limited either as long as fixability of toner is suitably improved and the property of the toner does not suffer, and it can be added within a conventional range.

Further, as described, a fluidizing agent may be added to toner as required as an external additive. The fluidizing agent is not particularly limited either, and specifically, silica fine particles which have been surface-treated with various drugs, or conductive titanium fine particles or silica fine particles are suitably adopted. Further, the amount of fluidizing agent added is not particularly limited either and it can be added within a conventional range.

More specifically, as the fluidizing agent for obtaining negatively charged toner, for example, silica fine particles which have been surface-treated with dimethyldichlorosilane or hexamethyldisilizane are suitably adopted. As the fluidizing agent for obtaining positively charged toner, for example, silica fine particles which have been surface-treated with a silicon oil are suitably adopted.

Further, in the present invention, it is particularly preferable to use one-component developer for color toners other than Bk, and in this case, the one-component developer may be magnetic one-component toner which suitably contains a magnetic substance such as magnetite, or non-magnetic one-component toner which does not contain a magnetic substance. On the other hand, since the toner of Bk is very preferably used in the form of the two-component developer, it is prepared by adding magnetic carriers such as iron powder, ferrite, magnetite, and magnetic resin carrier.

Thus, in the present invention, the method of controlling (adjusting) the charged quantity of toner (Q/M) is not particularly limited and preferably includes i) selecting the type of charge controlling agent (CCA) added to toner, ii) selecting the type of external additive (fluidizing agent) of toner, iii) changing the amount of charge controlling agent added, iv) changing the dispersed state of charge controlling agent by varying kneading time of the charge controlling agent in the manufacturing process, and v) varying the pressure of contact of the doctor blade for charging toner.

In the case of methods i) and ii), the type of charge controlling agent or external additive selected is not particularly limited as it is suitably selected depending on the other components (binder resin and coloring agent, etc.) of the toner. In the case of methods iii) through v), within the foregoing conventional range and to vary the quantity of charge at a certain ratio, the amount of charge controlling agent added is changed, or kneading time, etc. is varied, or the pressure of contact of the doctor blade is changed within a range which does not prevent toner supply, and thus specific numerical values are not particularly limited.

(Method 3) The developing potential ($|V_L-Vbias|$) of the plurality of image forming stations of the tandem disposition is decreased toward the downstream side. In this method, the quantity of charge applied to the toner which forms a later toner image in development is decreased by adjusting the developing potential ($|V_L-Vbias|$) so as to prevent the back-transfer phenomenon in transfer.

In this method, the developing potential ($|V_L-Vbias|$) when developing the electrostatic image on the surface of the photoreceptor is decreased toward the downstream side at a certain ratio, thus reducing the electrostatic attraction force acting between the reversely charged toner or weakly charged toner and the photoreceptor. As a result, back-transfer of toner from the transfer medium to the surface of the photoreceptor is prevented, thereby preventing occurrence of the back-transfer transfer phenomenon in the image forming stations of the downstream side.

Specifically, in the present invention, it is preferable that the developing potential ($|V_L-Vbias|$) is set to decrease toward the downstream side at a certain ratio. Such a ratio is not particularly limited as long as it does not prevent toner transfer, yet, generally, the developing potential ($|V_L-Vbias|$) for sufficiently developing the electrostatic image is preferably in a range of not less than 50 V and not more than 200 V.

Thus, in the present invention, the developing potential ($|V_L-Vbias|$) is preferably decreased toward the downstream side within a range of not less than |5| V and not more than |15| V for each decrement. Representing the decrement ratio in percent, using the developing potential ($|V_L-Vbias|$) of the developing device of the most upstream side as a reference, the developing potential ($|V_L-Vbias|$) is preferably decreased within a range of not less than 2% and not more than 10% for each decrement. Specifically, for example, when the developing potential ($|V_L-Vbias|$) of the developing device of the most upstream side is 150 V, the developing potential ($|V_L-Vbias|$) is decreased by |15| V for each decrement in order from 135 V, 120 V, and 105 V. The decrement ratio in this case is about 10% with the reference developing potential of the developing device at the most upstream side.

Specific methods of decreasing the developing potential ($|V_L-Vbias|$) at a certain ratio include, for example, but not particularly limited to the method of varying an applied voltage to the developing roller (developing bias voltage) while holding the electrostatic latent potential $V_L$ constant, and the method of varying the electrostatic latent potential $V_L$ by changing the output of the exposing means (e.g., laser beam output in the case of LSU) while holding the applied voltage Vbias of the developing roller constant.

Note that, in any of the foregoing methods, the voltage value is varied within the conventional range and to vary the developing potential ($|V_L-Vbias|$) at a certain ratio, and it is not limited to specific numerical values.

(Method 4) The average particle size (average particle size by volume) of developers of respective colors used in development of the electrostatic latent images in the developing devices of the plurality of image forming stations of the tandem disposition is increased toward the downstream side. In this method, by increasing the average particle size of toner which forms the toner image, the chargeability is decreased.

In this method, the average particle size of developer, i.e., toner becomes larger toward the downstream side, and accordingly the electrostatic attraction force needed for toner movement is relatively increased. Therefore, even when the preceding toner image includes reversely charged toner and/or weakly charged toner, toner movement is suppressed when such an electrostatic attraction force as to cause ordinary toner to move at transfer of the later toner image acts, and thereby the electrostatic attraction force acting between the reversely charged toner or the weakly charged toner and the photoreceptor becomes small. As a result, back-transfer of toner from the transfer medium to the surface of the photoreceptor is prevented, thus preventing occurrence of the back-transfer phenomenon in the image forming stations of the down stream side.

Specifically, in the present invention, the average particle size of toner is set to increase toward the downstream side at a certain ratio. Such a ratio is not particularly limited as long as it does not prevent development of electrostatic image and transfer of toner image, but, generally, the average particle size of toner which employs binder resin is preferably in a range of not less than 3 $\mu$m to not more than 15 $\mu$m.

Thus, in the present invention, the particle size of toner is preferably increased toward the downstream side within a range of not less than 1 $\mu$m to not more than 2 $\mu$m for each increment, and more preferably by the increment of about 2 $\mu$m. Representing the increment ratio in percent, using the average particle size of toner at the most upstream side as a reference, the average particle size of toner is preferably increased toward the downstream side within a range of not less than 10% and not more than 20% for each increment. Specifically, for example, when the average particle size of toner at the most upstream side is about 6 $\mu$m, the average particle size is increased by the increment of about 1 $\mu$m in order from about 7 $\mu$m, about 8 $\mu$m, and about 9 $\mu$m. The increment ratio in this case is about 17% with the reference average particle size of 6 $\mu$m of toner of the most upstream side.

The toner used in the present invention is as described in method 2 and the producing method thereof is the same as conventional methods, and details of the producing method are not particularly limited.

The present embodiment describes a common producing method of toner. First, raw materials such as binder resin (e.g., 100 parts in weight of polyester) and coloring agent (e.g., 5 parts in weight of copper phthalocyanine) are blended with the charge controlling agent and other additives such as the fixability improving agent in predetermined amount and are mixed therewith in a mixing device, for example, such as a super mixer to obtain a homogeneous mixture (mixing step).

The mixture is then melted by heat and kneaded by a kneader such as a biaxial extruder (kneading step). After kneaded, the mixture is air cooled or water cooled (cooling step), and the resulting aggregate is coarse-pulverized by a crusher such as a cutting mill, and then pulverized by an ultrasonic jet mill (pulverizing step). Then, the particles obtained by pulverization are classified by various classifying devices to remove fine particles, for example, having a particle size by volume of 5 $\mu$m or less (classifying step) so as to obtain toner of a predetermined particle size whose particle size distribution based on particle size by volume falls within a range of not less than 5 $\mu$m and not more than 16 $\mu$m, and whose particle size by volume falls within a range of not less than 8.0 $\mu$m and not more than 8.5 $\mu$m.

Here, in the present invention, by suitably setting the particle size of toner finally obtained, toner with various particle sizes can be obtained. As a result, it is possible to produce toner of plural colors so as to increase the particle size at a certain ratio toward the downstream side.

Note that, after the classifying step, a step of adding external additives may be performed to suitably add and mix external additives to have a substantially homogeneous mixture. Further, in the case of the two-component developer, a step of adding a carrier will be required to add and mix a carrier. Also, the foregoing producing method is subject to modifications depending on material, type, or characteristics of toner to be produced, and accordingly not all steps described above will be required, and, evidently, other additional steps may be added as well.

In this manner, the present invention employs at least one of, or preferably two of, or more preferably all of the foregoing methods 1 through 4 in the color image forming device of the tandem system or semi-tandem system to reduce the electrostatic attraction force acting on the photoreceptor with respect to reversely charged toner and/or weakly charged toner which exists on the photoreceptor, in a direction from the upstream side toward downstream side of the transport or moving direction of the intermediate transfer medium or recording medium. (4) This prevents occurrence of the back-transfer phenomenon of toner, thus efficiently obtaining a color image with superior color reproducibility.

Particularly, by employing the described arrangement of the image forming stations in the image forming section, it is possible (1) to prevent increase in size of the entire device, (2) to increase the size of the image forming station of Bk which is frequently used in image formation to adapt to large counts of monochromatic (black and white) image formation and to independently dispose the single image forming station of Bk, and therefore (3) to increase the first copying speed of monochromatic (black and white) image formation which is frequently used in image formation, and (4) to prevent occurrence of the back-transfer phenomenon of toner to efficiently obtain a color image with superior color reproducibility, thereby obtaining a small color image forming device with superior image quality and fast image forming speed.

Note that, the back-transfer phenomenon may also occur even when the preceding toner image does not include improperly charged toner. For example, referring to FIG. 12, when the recording medium 4 comes into contact with the surface of the photoreceptor drum 15, at the point of contact with the surface of the photoreceptor drum 15 where no transfer voltage is applied, there is a case where some of the toner 51 is transferred back to the surface of the photoreceptor drum 15 without being attracted to the surface of the transfer medium 4.

In such a case, the plurality of image forming stations of the tandem disposition from the upstream side toward the downstream side are adopted to make the sheet of paper to attract toner more easily. Specifically, a method such as the foregoing methods 1 through 4 is adopted so that various conditions are increased if they are desired to decrease toward the downstream side, and inversely, decreased if desired to increase towards the downstream side.

As described, the present invention relates to an image forming device in which a plurality of toner image forming means for forming and transferring toner images onto the transfer medium are disposed side by side along a transport or moving direction of the transfer medium so as to allow the plurality of toner images to be successively transferred one over another with respect to the transfer medium, wherein the toner image forming means includes transfer means which transfers the toner image formed onto the transfer medium, and the transfer voltage of transfer means of the toner image forming means of the downstream side of the transport or moving direction is set to be lower than the transfer voltage of transfer means of the toner image forming means of the upstream side.

With this arrangement, the transfer voltage of the toner image is decreased toward the downstream side. Thus, even when the preceding toner image includes reversely charged toner or weakly charged toner, the electrostatic attraction force acting between the reversely charged toner or weakly charged toner and the photoreceptor also becomes smaller. As a result, back-transfer of toner from the transfer medium to the surface of the photoreceptor is prevented, thus effectively preventing occurrence of the back-transfer phenomenon in the image forming stations of the downstream side, thereby forming a high quality image.

Alternatively, the present invention may be adopted so that the charged quantity of toner used in the image forming means of the downstream side in the transport or moving direction is set to be lower than the charged quantity of toner used in the image forming means of the upstream side.

Here, the charged quantity of toner is preferably set by at least one of the following methods: a method of selecting the type of external additives of toner, a method of changing the amount of charge controlling agent added, a method of changing the dispersed state of charge controlling agent, and a method of varying the pressure of contact of the doctor blade for charging toner.

With this arrangement, the charged quantity of developer, i.e., toner is decreased toward the downstream side. Thus, even when the preceding toner image include reversely charged toner or weakly charged toner, the transfer voltage applied to transfer the later toner image can be decreased, and the electrostatic attraction force acting between the reversely charged toner or weakly charged toner and the photoreceptor also becomes smaller. As a result, back-transfer of toner from the transfer medium to the surface of the photoreceptor is prevented, thus effectively preventing occurrence of the back-transfer phenomenon in the image forming stations of the downstream side, thereby forming a high quality image.

Alternatively, the present invention may be adopted so that the toner image forming means includes an image carrier for carrying an electrostatic latent image, and developing means for developing the electrostatic latent image which is carried on the image carrier, and the developing potential of developing means of the toner image forming means of the downstream side of the transport or moving direction is set to be lower than the developing potential of developing means of the toner image forming means of the upstream side.

Here, the developing potential is preferably set by the method of varying the applied voltage to the developing means while holding the electrostatic latent potential constant, or by the method of varying the electrostatic latent potential while holding the applied potential to the developing means constant.

With this arrangement, the developing potential $|V_L - Vbias|$ used to develop the electrostatic latent image on the photoreceptor with toner is made smaller toward the downstream side. Thus, the electrostatic attraction force acting between the reversely charged toner or weakly charged toner and the photoreceptor also becomes smaller. As a result, back-transfer of toner from the transfer medium to the surface of the photoreceptor is prevented, thus effectively preventing occurrence of the back-transfer phenomenon in the image forming stations of the downstream side, thereby forming a high quality image.

Alternatively, the present invention may be adopted so that the particle size of toner used in toner image forming means of the downstream side in the transport or moving direction is set to be larger than the particle size of toner used in toner image forming means of the upstream side.

With this arrangement, the particle size of developer, i.e., toner is made larger toward the downstream side. Thus, the electrostatic attraction force required for toner movement becomes relatively larger. Therefore, even when the preceding toner image includes reversely charged toner or weakly charged toner, toner movement is prevented even when there is an electrostatic attraction force which would move normal toner in transfer of the later toner image, thus reducing the electrostatic attraction force acting between the reversely charged toner or weakly charged toner and the surface of the photoreceptor. As a result, back-transfer of toner from the transfer medium to the surface of the photoreceptor is prevented, thus effectively preventing the back-transfer phenomenon in the image forming stations of the downstream side, thereby forming a high quality image.

Therefore, in addition to any of the foregoing arrangements, the image forming device in accordance with the present invention very preferably has an arrangement including one or more chromatic toner image forming means for forming a chromatic toner image and a single black toner image forming means for forming a black toner image as the plurality of toner image forming means, and in which the transfer medium is an intermediate transfer belt which is suspended in a horizontal direction in the main body of the device and which is in the form of a belt, wherein the chromatic toner image forming means are disposed side by side on one side of the intermediate transfer belt, and the black toner image forming means is independently disposed on the other side of the intermediate transfer belt and on the most downstream side of all the toner image forming means.

With this arrangement, it is possible to prevent increase in size of the entire device, to increase the size of the toner image forming means of Bk which is frequently used in image formation to adapt to large counts of monochromatic (black and white) image formation and to independently dispose the single toner image forming means of Bk, and therefore to increase the first copying speed of monochromatic (black and white) image formation which is frequently used in image formation, and to prevent occurrence of the back-transfer phenomenon of toner to efficiently obtain a color image with superior color reproducibility, thereby obtaining a small color image forming device with superior image quality and fast image forming speed.

That is, in the present invention, the image forming device is arranged to include a plurality of toner image forming means for forming and transferring toner images onto the transfer medium, which are disposed side by side along the transport or moving direction of the transfer medium so as to allow the plurality of toner images to be successively transferred one over another with respect to the transfer medium, wherein assuming that a toner image to be first transferred onto the transfer medium is a preceding toner image, and a toner image to be transferred after the preceding toner image is a later toner image, when at least the preceding toner image includes improperly charged toner, a control is performed to reduce chargeability of the later toner image when transferring the later toner image.

Further, in the image forming device in accordance with the present invention, when the preceding toner image does not include improperly charged toner, a control may be performed to improve chargeability of the later toner image when transferring the later toner image.

In any of the foregoing arrangement, when the toner image forming means are in the tandem disposition, the chargeability of the later toner image is changed when transferring the later toner image by the toner image forming means of the downstream side. Further, when there is no improperly charged toner, the chargeability of the later toner image at the time of transfer is improved to make the toner image to be attracted to the transfer medium more easily. As a result, it is possible to effectively prevent occurrence of the back-transfer or re-transfer phenomenon.

[Second Embodiment]

The following will explain another embodiment of the present invention with reference to drawings. For ease of explanation, components having the same functions as those shown in the drawings pertaining to the First Embodiment above will be given the same reference numbers, and explanation thereof will be omitted here. In addition, the present invention is not limited thereto.

Figure 3:
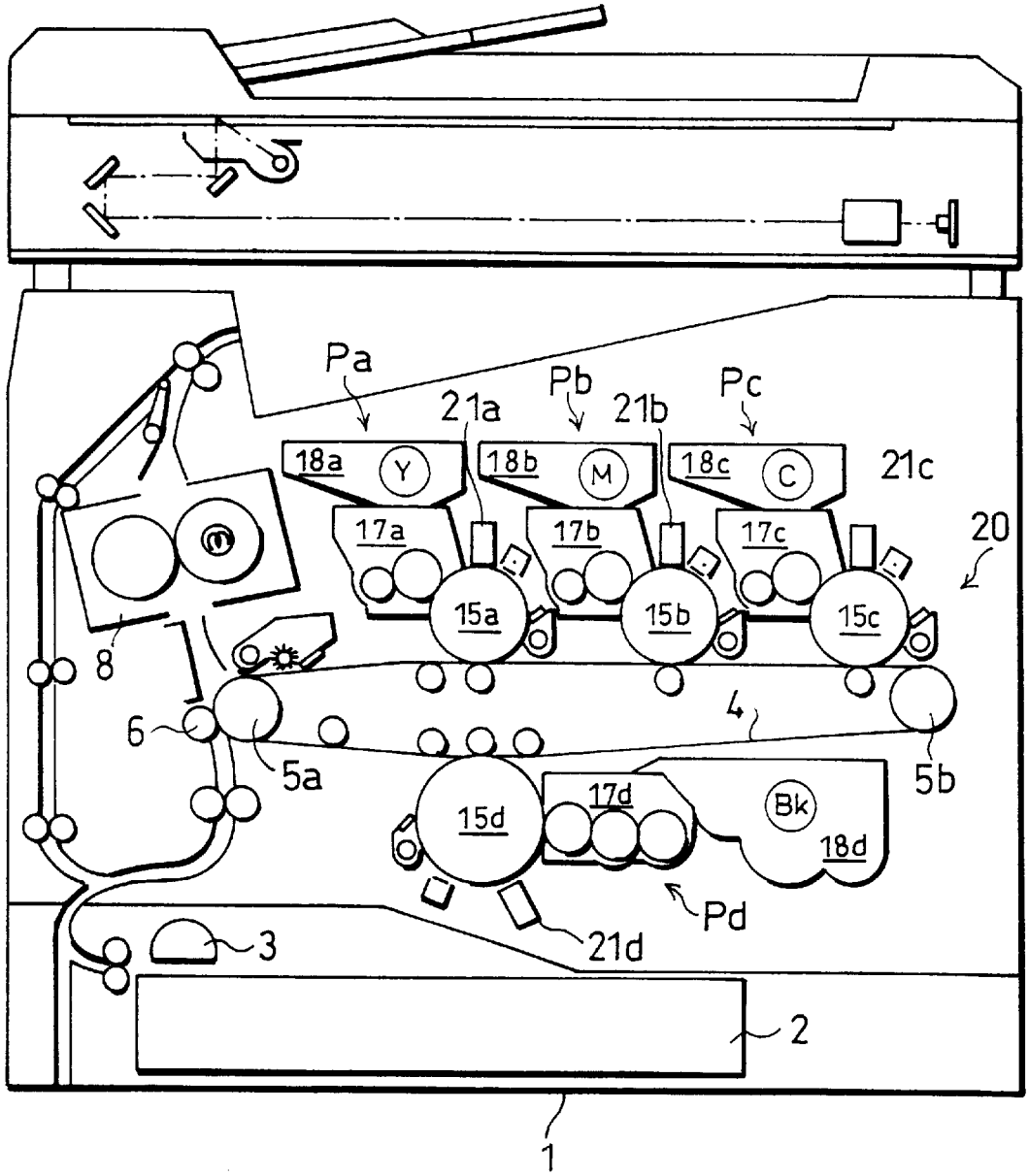
FIG. 3 is a cross sectional view showing a schematic structure of a color image forming device according to another embodiment of the present invention.
Figure 4:
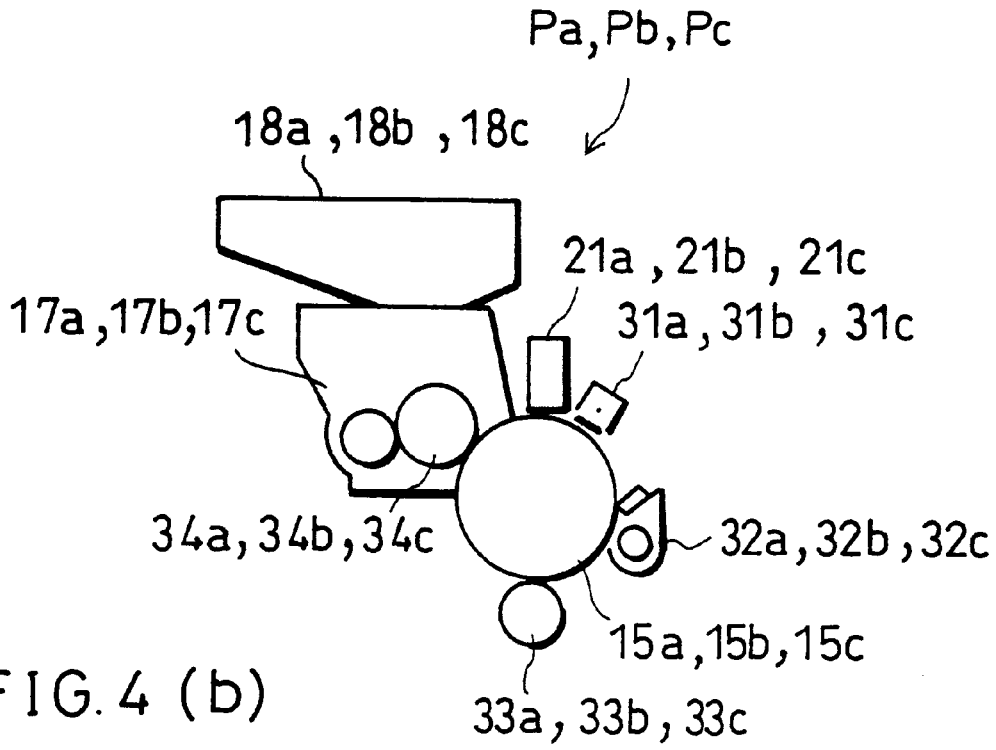
FIG. 4(*a*) is a schematic cross sectional view showing a structure of an image forming station dealing with each color of Y, M or C, which is included in an image forming section of the color image forming device of FIG. 3.
Figure 4:
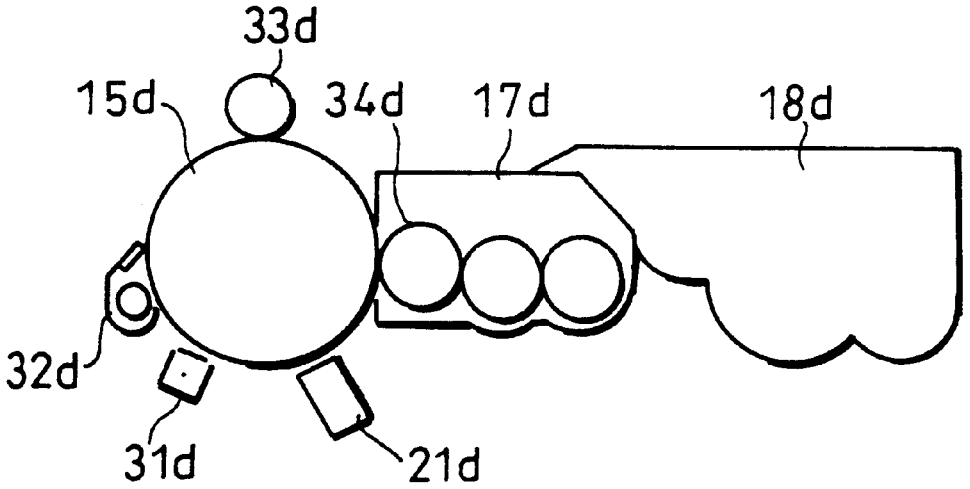

As shown in FIGS. 3, 4(*a*) and 4(*b*) , an image forming device of the present embodiment has substantially the same arrangement as the image forming device of the First Embodiment, except for exposing means to be included in image forming stations Pa, Pb, Pc and Pd, which are an LED (Light-Emitting Diode) arrays 21*a*, 21*b*, 21*c* and 21*d* herein, instead of the LSU 16*a*, 16*b*, 16*c* and 16*d*.

The LSU and the LED array are both suitably utilized in image formation based on digital information, but the LED array in particular, compared with the LSU, has such an advantage that it does not require a complex optical system such as a polygon mirror and a fθ lens, and thereby a capacity as the exposing means can be reduced.

Therefore, by using the smaller LED arrays 21*a* through 21*d* as the exposing means in the image forming stations Pa through Pd, as shown in FIGS. 3, 4(*a*) and 4(*b*), the LED arrays 21*a* through 21*d* can be disposed in a vicinity of the developing devices 17*a* through 17*d*. Consequently, it is no longer necessary to provide the exposing means in a position above or below the developer tanks 18*a* through 18*d* (see FIGS. 1, 2(*a*) and 2(*b*)), thus largely suppressing increase in the sizes of the image forming stations Pa through Pd.

Particularly in the image forming section 20, as described, the image forming stations Pa through Pc which are disposed above the intermediate transfer belt 4 have the longitudinal shape with an inclination to extend one-dimensionally, and the First Embodiment has an arrangement in which the LSU 16*a* through 16*c* with larger capacity are made larger particularly in a one-dimensional direction. Therefore, by using the LED arrays 21*a* through 21*c* with smaller capacity, instead of the LSU 16*a* through 16*c,* the size of the device main body 1 in a vertical direction (direction of height) can be greatly reduced.

Accordingly, all the LSUs are replaced with the LED arrays in the foregoing example, but the present embodiment may also have an arrangement in which the LSU 16*a,* 16*b* and 16*c* of the image forming stations Pa, Pb and Pc are respectively replaced with the LED arrays 21*a,* 21*b* and 21*c,* but the LSU 16*d* remains as the exposing means of the image forming station Pd.

Thus, the image forming device according to the present embodiment, in addition to the foregoing arrangement explained in the First Embodiment, has an arrangement in which the plurality of toner image forming means respectively include exposing means for exposing a surface of an image carrier which carries an electrostatic latent image so as to form the electrostatic latent image, wherein the light-emitting diode array is used as the exposing means.

With the foregoing arrangement, the light-emitting diode array (LED array) is suitably used in image formation based on digital information, and therefore, in a particular case where the image forming device according to the present invention is a digital color image forming device, a high-quality color image can be formed.

The image forming device according to the present embodiment, in addition to the foregoing arrangement, has an arrangement in which the light-emitting diode array is used as exposing means which is included in the chromatic color toner image forming means.

With the foregoing arrangement, since the light-emitting diode array (LED array) which is much smaller than the LSU is used, particularly, as the exposing means which is included in the chromatic color toner image forming means with the tandem disposition, the size of the device main body in a vertical direction (direction of height) can be largely reduced.

[Third Embodiment]

The following will explain another embodiment of the present invention with reference to drawings. For ease of explanation, components having the same functions as those shown in the drawings pertaining to the First and Second Embodiments above will be given the same reference numbers, and explanation thereof will be omitted here. In addition, the present invention is not limited thereto.

Figure 5:
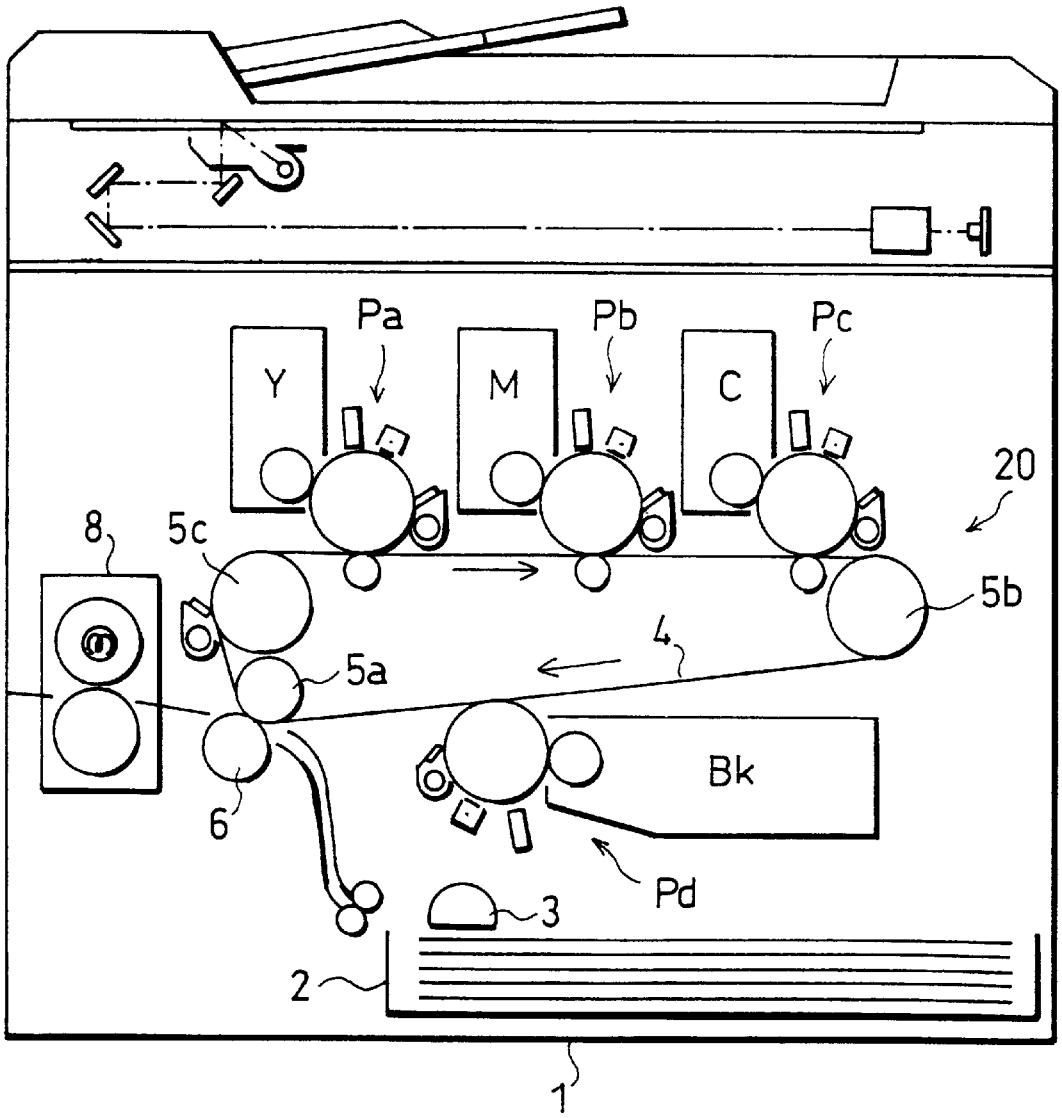
FIG. 5 is a cross sectional view showing a schematic structure of a color image forming device according to another embodiment of the present embodiment.

As shown in FIG. 5, in a color image forming device of the present embodiment, the intermediate transfer belt 4 is suspended by three suspension rollers 5*a,* 5*b* and 5*c* in a substantially horizontal direction. Note that, the other arrangements herein are the same as the arrangements of each embodiment above, except for exposing means which is the LED array described in the Second Embodiment.

Specifically, among the three suspension rollers 5*a* through 5*c,* the suspension rollers 5*b* and 5*c* are disposed side by side in a horizontal direction, and below the suspension roller 5*c* is disposed the suspension roller 5*a,* the three suspension rollers 5*a,* 5*b* and 5*c* thus disposed suspending the intermediate transfer belt 4 in a substantially triangular form.

Consequently, the image forming stations Pa, Pb and Pc are disposed on a side of a horizontal plane (upper side) of the intermediate transfer belt 4 between the suspension rollers 5*c* and 5*b* (corresponding to "one side of the intermediate transfer belt 4" in the First Embodiment; see FIG. 1), thereby making it possible to dispose the image forming stations Pa, Pb and Pc with the tandem disposition along the suspending direction of the intermediate transfer belt 4.

Additionally, the image forming station Pd is disposed on a side of a plane having a slight tilt (lower side) of the intermediate transfer belt 4 between the suspension roller 5*b* and 5*a* (corresponding to "the other side of the intermediate transfer belt 4 in the First Embodiment; see FIG. 1), thereby making it possible to efficiently store the image forming station Pd in a spacing having a shape of a substantially flat plate beneath the intermediate transfer belt 4 and above the sheet feeder cassette 2.

Particularly, the intermediate transfer belt 4 between the suspension rollers 5*b* and 5*a* are different from that between the suspension rollers 5*c* and 5*b,* which is to be suspended with a slight tilt. Therefore, in a vicinity of a position where the feeder roller 3 is provided the suspension roller 5*a,* while a spacing on a side without the feeder roller 3 increases. As a result, since a spacing in which the image forming station Pd is disposed increases, the image forming station Pd can be more readily disposed, while increasing the size of the image forming station Pd, by providing it for a monochromatic image which is frequently used in image formation.

Further, as discussed, the suspension roller 5*a* is disposed in a vicinity of a position where the feeder roller 3 of paper feeding means is disposed, thereby disposing the transfer roller 6 in a position opposing to the suspension roller 5*a* in the same manner as each of the foregoing embodiment. Therefore, respective rollers of the feeder roller 3, the suspension roller 5*a* and the transfer roller 6 are disposed in a position where the rollers are adjacent, thus efficiently utilizing space.

Further, on a side of a substantially vertical plane, and on a position opposing to the suspension roller 5*c,* the cleaning device 7 is disposed. Thus, the cleaning device 7 is not necessarily disposed with the image forming stations Pa, Pb and Pc side by side. That is, space extending in left and right directions to store the cleaning device 7 side by side the image forming stations Pa, Pb and Pc can be omitted.

As a result, the size of the device main body 1 can be reduced. In addition, since the cleaning device 7 is disposed on a substantially vertical part of the intermediate transfer belt 4, when cleaning residual toner on the intermediate transfer belt 4, the residual toner which was scraped with a blade can be received in a lower part. Accordingly, utilizing an own weight of toner, the cleaning of the residual toner can be performed readily and surely.

Additionally, since the suspension rollers 5*c* and 5*d* are disposed adjacently, each belt length between these suspension rollers 5*c* and 5*a* is shortest compared with the other components, and inside the device main body 1, suspended in the substantially vertical direction. Therefore, in the present embodiment, as each of the foregoing embodiment, in which two suspension rollers 5*a* and 5*b* suspend the intermediate transfer belt 4, the intermediate transfer belt 4 can be suspended in the shape of the substantially flat plate.

Note that, in the present embodiment, the fixing device 8 is not disposed above but on one side of the intermediate transfer belt 4, and therefore, the discharge tray 10 is not provided in a position which is on the device main body 1 and under the document reading device 19 but on one side of the device main body 1 (the discharge tray 10 is not shown in FIG. 5). However, an arrangement of the present invention is not limited to this, and as in the First and Second Embodiments above, the discharge tray 10 can also be provided in a position which is on the device main body 1 and under the document reading device 19.

Thus, the image forming device according to the present embodiment, in addition to the First or Second Embodiment above, has an arrangement further including cleaning means for cleaning residual toner on the intermediate transfer belt, wherein the intermediate transfer belt which is suspended in the shape of the substantially flat plate is suspended by two suspension rollers which are disposed adjacently in a substantially vertical direction, and by one suspension roller which is disposed in a position apart from the two suspension rollers, and the cleaning means is disposed so as to face the intermediate transfer belt which is suspended in a substantially vertical direction by the two suspension rollers which are disposed adjacently.

With the foregoing arrangement, it is possible to dispose the transport roller, the suspension roller and the transfer means in adjacent positions, thereby more efficiently utilizing space. Moreover, since the cleaning means is disposed on a substantially vertical side of the intermediate transfer belt between the adjacently disposed suspension rollers, it is unnecessary to dispose the cleaning means to be in parallel with the toner image forming means, thereby reducing space of the device main body on both sides.

In addition, since the cleaning means is disposed on a substantially vertical part, when cleaning residual toner on the intermediate transfer belt, the residual toner which was scraped with a blade can be received in a lower part. Accordingly, utilizing an own weight of toner, the cleaning of the residual toner can be performed readily and surely.

[Fourth Embodiment]

The following will explain another embodiment of the present invention with reference to drawings. For ease of explanation, components having the same functions as those shown in the drawings pertaining to the First through Third Embodiments above will be given the same reference numbers, and explanation thereof will be omitted here. In addition, the present invention is not limited thereto.

Figure 6:
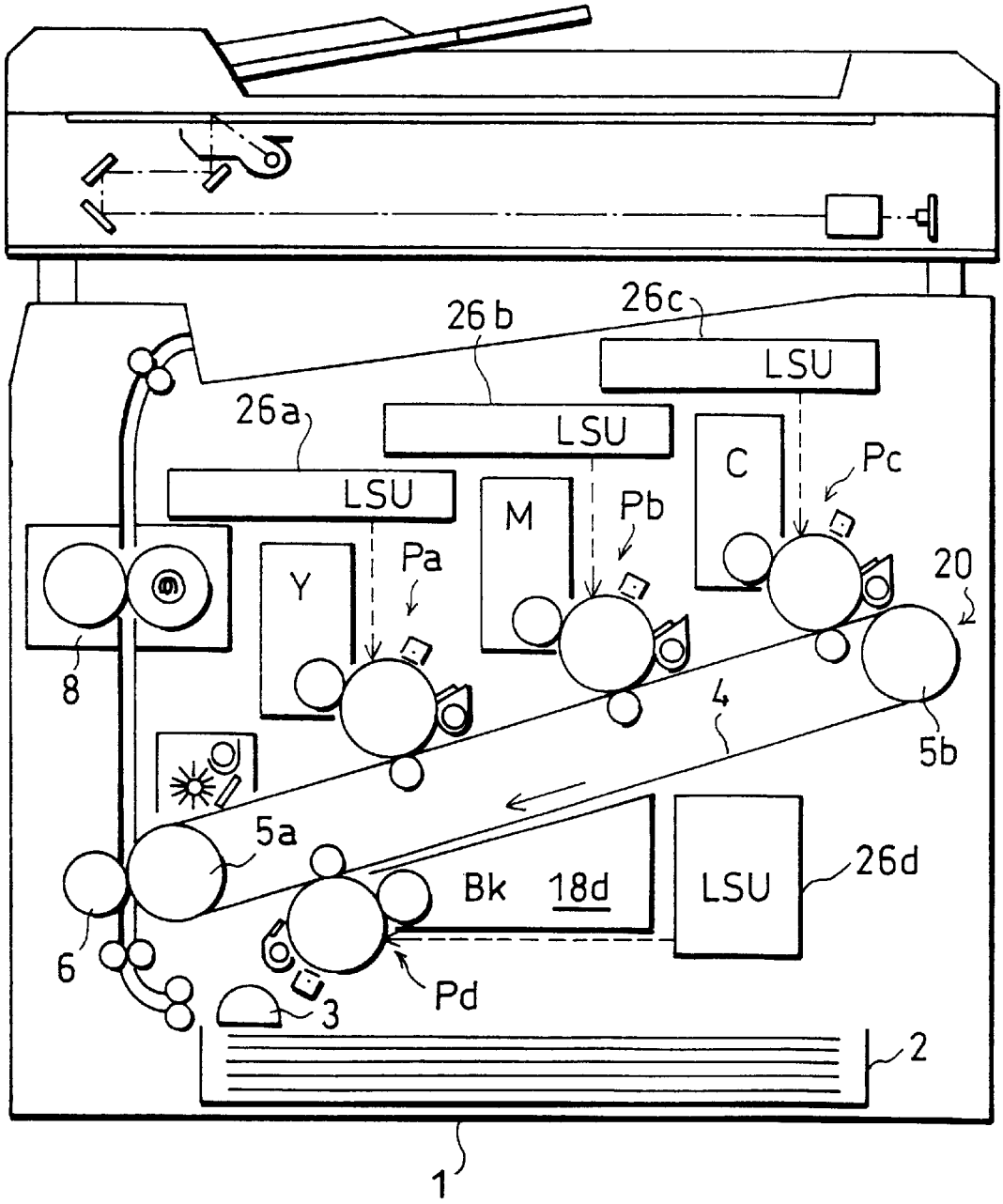
FIG. 6 is a cross sectional view showing a schematic structure of a color image forming device according to a further embodiment of the present embodiment.
Figure 7:
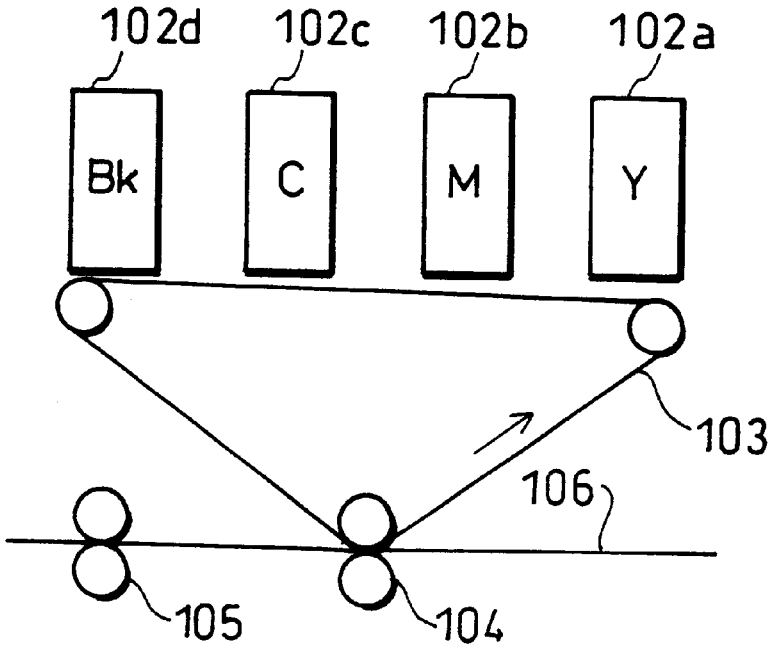
FIG. 7 (PRIOR ART)
FIG. 7 is a type drawing showing a schematic structure of an image forming section of a conventional color image forming device.
Figure 8:
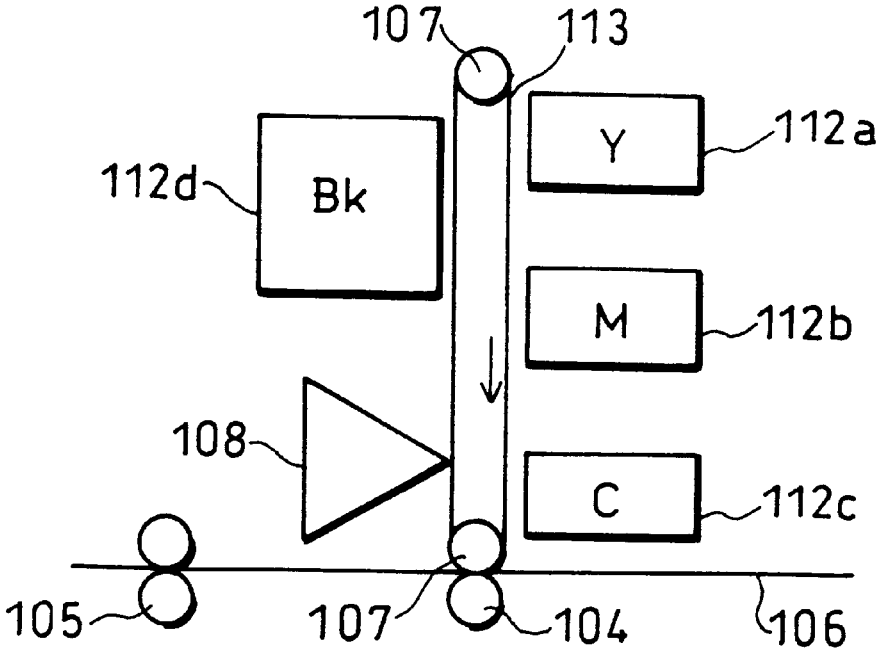
FIG. 8 (PRIOR ART)
FIG. 8 is a type drawing showing a schematic structure of an image forming section of another conventional color image forming device.
Figure 9:
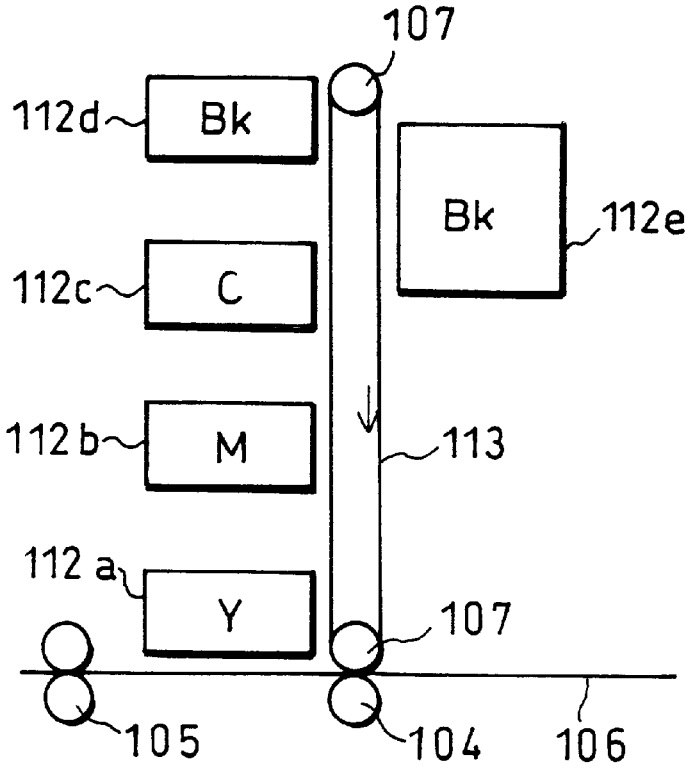
FIG. 9 (PRIOR ART)
FIG. 9 is a type drawing showing a schematic structure of an image forming section of a further conventional color image forming device.
Figure 10:
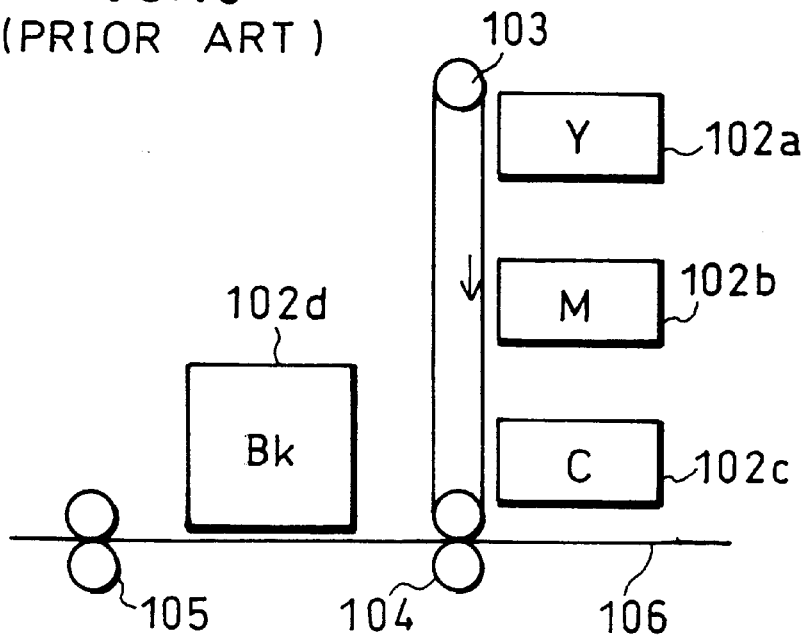
FIG.10 (PRIOR ART)
FIG. 10 is a type drawing showing a schematic structure of an image forming section of a still further conventional color image forming device.
Figure 11:
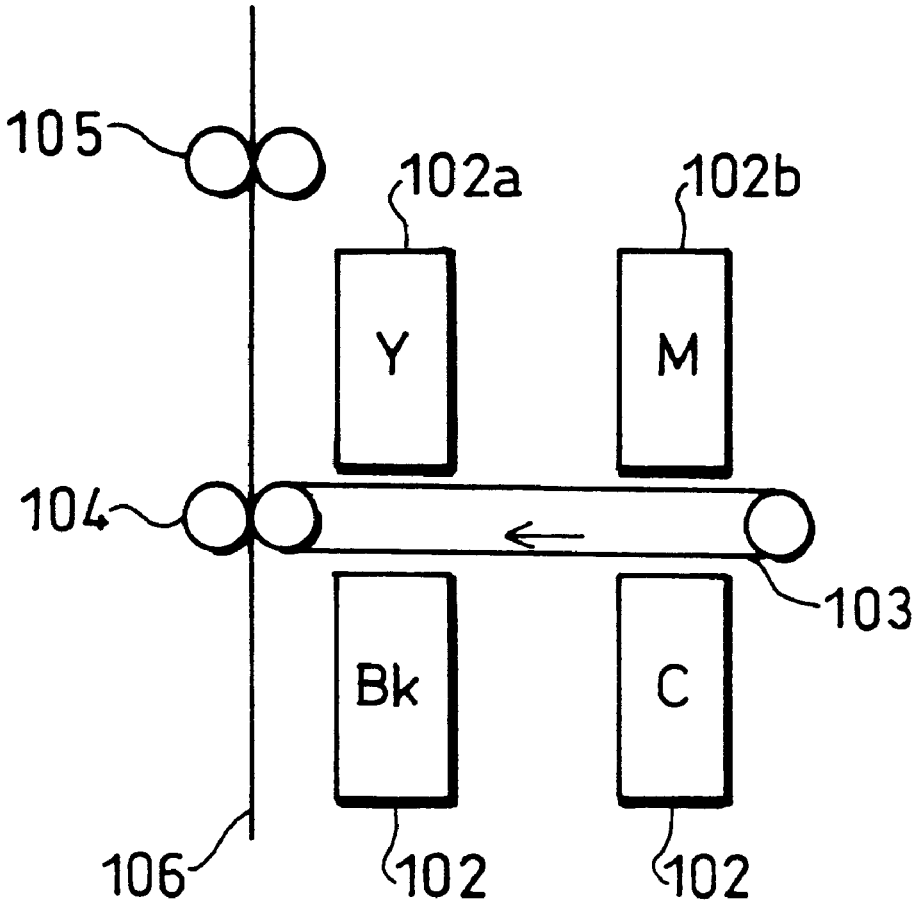
FIG. 11 (PRIOR ART)
FIG. 11 is a type drawing showing a schematic structure of an image forming section of an even further conventional color image forming device.

As shown in FIG. 6, in an image forming device of the present embodiment, the intermediate transfer belt 4 is suspended diagonally. Specifically, the two suspension rollers 5*a* and 5*b* suspending the intermediate transfer belt 4 are disposed in such a manner that the suspension roller 5*b* is disposed in an upper part than the suspension roller 5*a* with respect to a horizontal direction. Thus, the intermediate transfer belt 4 is suspended diagonally by the suspension roller 5*b* in the upper part and the suspension roller 5*a* in a lower part. Note that, the other arrangements herein are the same as the arrangements of each embodiment above, except for exposing means which are the LSU 26*a* through 26*d* described in the First Embodiment.

In the present embodiment, by diagonally disposing the intermediate transfer belt 4, the size of the image forming device in a width direction is reduced, thereby reducing a spacing of installation. Specifically, as shown in FIG. 6, LSUs 26*a* through 26*c* in color image formation of the present embodiment have a flat shape. Therefore, in an arrangement in which the image forming stations Pa through Pc are simply disposed side by side, spacings should be secured for the LSU 26*a* through 26*c* between either of the image forming stations Pa and Pb or Pb and Pc.

However, in the present embodiment, since the intermediate transfer belt 4 is diagonally disposed, as shown in FIG. 6, by disposing a part of the LSUs 26*a* through 26*c* having the flat shape so as to overlap the adjacent LSU 26*a* through 26*c,* spacings among the foregoing image forming stations Pa through Pc can be narrowed, thereby reducing the size of an entire image forming device in the width direction, and as a result, reducing the spacing of installation.

Meanwhile, even when using the LEDs instead of the LSUs 26*a* through 26*d* as an exposure device (not shown), though the height of the image forming device increases to some extent by diagonally disposing the intermediate transfer belt 4, the distance between the respective LEDs can be reduced in size (the image forming stations Pa through Pc are disposed with highest density), thus also reducing the size of the image forming device in the width direction, and reducing an area of installation.

Further, as discussed, a spacing between the intermediate transfer belt 4 and the device main body 1 can also be made large by diagonally suspending the intermediate transfer belt 4 in the same manner as the Third Embodiment above. Particularly in this case, by making a tilt angle large, a larger spacing can be secured than the Third Embodiment.

In the First through Third Embodiments above, a spacing between the intermediate transfer belt 4 and the sheet feeder cassette 2 was a spacing having a shape of a substantially flat plate, but in the present Fourth Embodiment, as shown in FIG. 6, it takes a substantially triangular prism form, thereby making it possible to secure a spacing so as to dispose the image forming station of Bk Pd and the LSU 26*d,* and to form a much larger capacity of the developer tank 18*d* of the image forming station of Bk Pd, and moreover, reducing the spacing of installation (area of installation).

Consequently, the tilt angle of the intermediate transfer belt 4 according to the present embodiment, when using the LSUs 26*a* through 26*c* having the flat shape, preferably falls within such a range as to secure a tilt state of the intermediate transfer belt 4, in which these LSUs 26*a* through 26*c* can be overlapped one another, or in the case of using the LEDs, it preferably falls within such a range as to secure a tilt state in which the image forming stations Pa through Pc are disposed with highest density. Therefore, a preferable range of the tilt angle of the intermediate transfer belt 4 is not particularly limited, but it is suitably set in accordance with a form, size, etc. of an image forming device.

Thus, from this point of view that the area of installation of an image forming device is reduced so as to attain an image forming device which is compact in size in the width direction as a whole, it becomes highly effective to have an arrangement in which the intermediate transfer belt 4 is tilted in the direction of height within an allowable range.

Namely, the image forming device according to the present embodiment has an arrangement in which either one of at least two of the suspension rollers which suspend the intermediate transfer belt is disposed in a position which is upper than the other with respect to the horizontal direction, so as to diagonally suspend the intermediate transfer belt.

With the foregoing arrangement, it is possible to reduce a spacing among a plurality of exposing means, to increase a capacity of a developer tank in black toner image forming means, and further, to reduce a spacing of installation (area of installation), thereby reducing the size of the image forming device in the width direction, and reducing the spacing of installation.

EXAMPLES

The following will explain further details of the present invention based on examples and comparative examples, but the present invention is not limited thereto. Note that, image fog (BG), image density (ID) and image gradation were measured and evaluated by methods as set forth below. In addition, toner which is used in the Examples and Comparative Examples was produced based on toner samples as set forth below, under the conditions of each example or comparative example, except for some change in compound quantity of components.

[Image Fog]

On a recording paper on which a color image of ISO/JIS-SCID-S7.tif is formed, density in a part without an image formed thereon, i.e., image fog (BG) was measured by a Color Meter ZE2000 (trade name; manufactured by NIPPON DENSHOKU). Here, measurement values were evaluated as follows: a value of not more than 0.35 is ○; a value in a range of 0.35 to 0.7 is Δ; and a value of not less than 0.7 is x.

[Image Density]

The density of cyan in a color image of ISO/JIS-SCID-S7.tif was measured by a PROCESS MEASUREMENTS RD914 type (trade name; manufactured by Macbeth). Here, measurement values were evaluated as follows: a value of not less than 1.3 is ○; a value in a range of 1.0 to 1.3 is Δ; and a value of not more than 1.0 is x.

[Image Gradation]

Gradation in a color image of ISO/JIS-SCID-S7.tif was evaluated as follows: reproduction of not less than 30 tones is ○; reproduction in a range of 10 to 30 tones is Δ; and reproduction of not more than 10 tones is x.

[Manufactured Samples of Toner]

The respective colors of Y, M, C and Bk in the present examples and comparative examples were produced by a conventionally known producing method as described in the First Embodiment above, with the following component and compound quantity.

That is, 100 parts in weight of polyester resin as binder resin, and as coloring agent, 4 parts in weight of PIG.Y74 for Y, 3 parts in weight of PIG.R122 for M, 5 parts in weight of PIG.B15 for C, and 6 parts in weight of carbon black for Bk, and 1.5 to 3 parts in weight of E84 (zing compound of salicylic acid) as charge controlling agent, were employed. Using these components, the steps of mixing, kneading, cooling, pulverizing and classifying were carried out so as to obtain toner having a predetermined particle size.

Note that, since toner of Bk was used as two-component developer, ferrite was employed as a carrier, and with respect to 6 parts in weight of Bk toner was added and mixed 100 parts in weight of a carrier.

Example 1

Employing AR-C150 (trade name; manufactured by SHARP) as the image forming device of the First Embodiment above (see FIG. 1), a color image (6% document) of ISO/JIS-SCID-S7.tif was formed with respect to 40,000 sheets of A4-sized PPC paper.

Here, a value of a voltage to be applied to an intermediate transfer roller 33*a* (see FIG. 2(*a*)) of an image forming station, which forms a first-color toner image (Y), was increased to the highest value, and the value of the voltage to be applied was controlled to decrease at a predetermined rate with respect to an intermediate transfer roller 33*b* (see FIG. 2(*a*)) of an image forming station Pb for forming a second-color toner image (M), an intermediate transfer roller 33*c* (see FIG. 2(*a*)) of an image forming station Pc for forming a third-color toner image (C), and an intermediate transfer roller 33*d* (see FIG. 2(*b*)) of an image forming station Pd for forming a fourth-color toner image (Bk), in this order.

Specifically, it was assumed that a transfer voltage to be applied to the intermediate transfer roller 33*a* was 2 kV, a transfer voltage to be applied to the intermediate transfer roller 33*b* was 1.7 kV, a transfer voltage to be applied to the intermediate transfer roller 33*c* was 1.4 kV, and a transfer voltage to be applied to the intermediate transfer roller 33*d* was 1.1 kV. Thus, using the transfer voltage to be applied to the intermediate transfer roller 33*a* as a reference, it was set that a transfer voltage was gradually decreased at a rate of 15% toward a downstream side.

Further, the BG, ID and gradation of a color image (0 K) which was formed first and a color image (40 K) which was formed in the end were respectively measured and evaluated. Table 1 shows results thereof.

Comparative Example 1

A color image was formed in the same manner as Example 1, except that the value of the voltage to be applied to the intermediate transfer roller 33*a* was set to be the lowest, and a value of the voltage to be applied was controlled to increase at a predetermined rate with respect to the intermediate transfer roller 33*b,* the intermediate transfer roller 33*c* and the intermediate transfer roller 33*d* in this order.

Specifically, it was assumed that the transfer voltage to be applied to the intermediate transfer roller 33*a* was 1 kV, the transfer voltage to be applied to the intermediate transfer roller 33*b* was 1.2 kV, the transfer voltage to be applied to the intermediate transfer roller 33*c* was 1.4 kV, and the transfer voltage to be applied to the intermediate transfer roller 33*d* was 1.6 kV. Thus, using the transfer voltage to be applied to the intermediate transfer roller 33*a* as a reference, it was set that the transfer voltage was gradually increased at a rate of 20% toward the downstream side.

Further, the BG, ID and gradation of the color image of 0 K and the color image of 40 K were respectively measured and evaluated. Table 1 shows results thereof.

Comparative Example 2

A color image was formed in the same manner as Example 1, except that the value of the voltage to be applied was controlled to be constant among all of the intermediate transfer roller 33*a,* the intermediate transfer roller 33*b,* the intermediate transfer roller 33*c* and the intermediate transfer roller 33*d.* Specifically, it was set that the transfer voltage to be applied to the intermediate transfer rollers 33*a* through 33*d* was equally 1.5 kV.

Further, the BG, ID and gradation of the color image of 0 K and the color image of 40 K were respectively measured and evaluated. Table 1 shows results thereof.

TABLE 1

| | B G | | I D | | Gradation | |
|---|---|---|---|---|---|---|
| | 0 K | 40 K | 0 K | 40 K | 0 K | 40 K |
| 1st Embodiment | ○ | ○ | ○ | ○ | ○ | ○ |
| C/Example 1 | x | x | ○ | x | ○ | x |
| C/Example 2 | ○ | Δ | ○ | x | ○ | Δ |

N.B. "C/Example" = Comparative Example

Thus, when individually controlling the transfer voltage to be applied to the intermediate transfer rollers 33*a* through 33*d,* in Example 1, desirable results were shown in all of the BG, ID and gradation of both color images of 0 K and 40 K. Thus, in the present invention, occurrence of back-transfer phenomenon can sufficiently be suppressed in the image forming stations Pb through Pd of the downstream side in a transfer process, thereby forming a desirable color image.

On the other hand, in the Comparative Example 1, fog was observed in both of 0 K and 40 K, and moreover, the density and gradation were largely reduced in 400 K, thus a desirable color image could not be obtained. In addition, in Comparative Example 2, in the case of 0 K, desirable results were obtained with respect to all of the BG, ID and gradation, but in the case of 40 K, occurrence of fog and/or reduction in gradation to some extent could not be prevented, and moreover, the density in particular was largely reduced, thus a desirable color image could not be obtained.

Comparative Example 3

A color image was formed in the same manner as Example 1, except that charged quantity of toner is set to be substantially the same in the respective developing devices 17*a* through 17*d* by producing toner so that a content of charge controlling agent (CCA) becomes substantially the same, the CCA being included in toner of each color for use in the respective developing devices 17*a* through 17*d* of the image forming stations Pa through Pd for the respective colors of Y, M, C and Bk.

Specifically, toner of respective colors of Y, M, C and Bk was produced in the same manner as in the foregoing manufacturing samples of toner, except that 2 parts in weight of the charge controlling agent E84. The specific charged quantity of toner for each color, which was obtained, became substantially the same −20 $\mu$C/g.

Further, the BG, ID and gradation of the color image of 0 K and the color image of 40 K were respectively measured and evaluated. Table 2 shows results thereof.

Example 2

A color image was formed in the same manner as Example 1, except that the CCA content of the toner of Y to be used in the developing device 17*a* of the image forming station Pa for forming the first-color toner image (Y) was assumed to be the maximum, and the CCA content of the toner of each color was decreased at a predetermined rate with respect to the developing device 17*b* of the image forming station Pb for transferring the second-color toner image (M), the developing device 17*c* of the image forming station Pc for transferring the third-color toner image (C), and the developing device 17*d* of the image forming station Pd for transferring the fourth-color toner image (Bk), in this order, so as to set the charged quantity of toner of each color to be low at a predetermined rate.

Specifically, the toner of the respective colors of Y, M, C and Bk was produced in the same manner as the foregoing manufacturing samples of toner, except that 3 parts in weight of the charge controlling agent E84 was used for Y, 2.5 parts in weight thereof was used for M, 2 parts in weight thereof was used for C, and 1.5 parts in weight thereof was used for Bk. The specific charged quantity of each toner obtained was as follows: −40 $\mu$C/g for Y, −32$\mu$C/g for M, −24$\mu$C/g for C, and −15 $\mu$C/g for Bk. Consequently, using the charged quantity of toner of the first color Y as a reference, it was set so that the charged quantity was gradually decreased at a rate of 20% toward the downstream side.

Further, the BG, ID and gradation of the color image of 0 K and the color image of 40 K were respectively measured and evaluated. Table 2 shows results thereof.

Comparative Example 4

A color image was formed in the same manner as Example 1, except that the CCA content of the toner of Y to be used in the developing device 17*a* of the image forming station Pa for forming the first-color toner image (Y) was assumed to be the minimum, and the CCA content of the toner of each color was decreased at a predetermined rate with respect to the developing device 17*b* of the image forming station Pb for transferring the second-color toner image (M), the developing device 17*c* of the image forming station Pc for transferring the third-color toner image (C), and the developing device 17*d* of the image forming station Pd for transferring the fourth-color toner image (Bk), in this order, so as to set the charged quantity of toner of each color to be high at a predetermined rate.

Specifically, the toner of the respective colors of Y, M, C and Bk was produced in the same manner as the foregoing manufacturing samples of toner, except that 1.5 parts in weight of the charge controlling agent E84 was used for Y, 2 parts in weight thereof was used for M, 2.5 parts in weight thereof was used for C, and 3 parts in weight thereof was used for Bk. The specific charged quantity of each toner obtained was as follows: 20 $\mu$C/g for Y, 27 $\mu$C/g for M, 34 $\mu$C/g for C, and 41 $\mu$C/g for Bk. Consequently, using the charged quantity of toner of the first color Y as a reference, it was set so that the charged quantity was gradually increased at a rate of 35% toward the downstream side.

Further, the BG, ID and gradation of the color image of 0 K and the color image of 40 K were respectively measured and evaluated. Table 2 shows results thereof.

TABLE 2

| | B G | | I D | | Gradation | |
|---|---|---|---|---|---|---|
| | 0 K | 40 K | 0 K | 40 K | 0 K | 40 K |
| C/Example 3 | ○ | Δ | ○ | x | ○ | Δ |
| 2nd Embodiment | ○ | ○ | ○ | ○ | ○ | ○ |
| C/Example 4 | Δ | x | ○ | Δ | ○ | Δ |

N.B. "C/Example" = Comparative Example

Thus, when changing settings of added quantity of CCA and charged quantity of developer in order to control the charged quantity of toner of each color for developing an electrostatic latent image corresponding to each color, in Example 2, desirable results were shown in the BG, ID and gradation of both of 0 K and 40 K. Therefore, according to the present invention, occurrence of the back-transfer phenomenon can sufficiently be suppressed in the image forming stations Pb through Pd of the downstream side in the transfer process, thereby forming a desirable color image.

On the other hand, in Comparative Example 3, desirable results were obtained in the BG, ID and gradation of 0 K, but occurrence of fog and/or reduction in gradation to some extent could not be prevented in the case of 40 K, and the density in particular was largely reduced, thus a desirable color image could not be obtained. Further, in Comparative Example 4, fog was observed in both of 0 K and 40 K, and moreover, the density and gradation were reduced to some extent in 40 K, thus a desirable color image could not be obtained.

Example 3

A color image was formed in the same manner as Example 1, except that a value of an applied voltage Vbias of a developing roller 34*a* in the developing device 17*a* of the image forming station Pa for forming the first-color toner image (Y) was assumed to be the maximum, and it was set that the value of the applied voltage Vbias was controlled to be reduced at a predetermined rate with respect to a developing roller 34*b* in the developing device 17*b* of the image forming station Pb for transferring the second-color toner image (M), a developing roller 34*c* in the developing device 17*c* of the image forming station Pc for transferring the third-color toner image (C), and a developing roller 34*d* in the developing device 17*d* of the image forming station Pd for transferring the fourth-color toner image (Bk), so as to set a developing voltage $|V_L-Vbias|$ to become low at a predetermined rate.

Specifically, it was arranged that the value of the applied voltage to the developing roller 34*a* of the developing device 17*a* was Vbias=−200 V, the value of the applied voltage to the developing roller 34*b* of the developing device 17*b* was Vbias=−190 V, the value of the applied voltage to the developing roller 34*c* of the developing device 17*c* was Vbias=−180 V, and the value of the applied voltage to the developing roller 34*d* of the developing device 17*d* was Vbias=−170 V. An electrostatic latent image voltage $V_L$ here was −50 V, and therefore a developing voltage of the developing roller 34*a* became $|V_L-Vbias|=150$ V, and a developing voltage of the developing roller 34*b* became $|V_L-Vbias|=140$ V, and a developing voltage of the developing roller 34*c* became $|V_L-Vbias|=130$ V, and a developing voltage of the developing roller 34*d* became $|V_L-Vbias|=120$ V. Thus, using the developing voltage $|V_L-Vbias|$ of the developing roller 34*a* as a reference, the developing voltage was set to become gradually low at a rate of 7% toward the downstream side.

Further, the BG, ID and gradation of the color image of 0 K and the color image of 40 K were respectively measured and evaluated. Table 3 shows results thereof.

Comparative Example 5

A color image was formed in the same manner as Example 1, except that the value of the applied voltage Vbias of the developing roller 34*a* in the developing device 17*a* of the image forming station Pa for forming the first-color toner image (Y) was assumed to be the minimum, and it was set that the value of the applied voltage Vbias was controlled to be increased at a predetermined rate with respect to the developing roller 34*b* in the developing device 17*b* of the image forming station Pb for transferring the second-color toner image (M), the developing roller 34*c* in the developing device 17*c* of the image forming station Pc for transferring the third-color toner image (C), and the developing roller 34*d* in the developing device 17*d* of the image forming station Pd for transferring the fourth-color toner image (Bk), so as to set the developing voltage $|V_L-Vbias|$ to become high at a predetermined rate.

Specifically, it was arranged that the value of the applied voltage to the developing roller 34*a* of the developing device 17*a* was Vbias=−200 V, the value of the applied voltage to the developing roller 34*b* of the developing device 17*b* was Vbias=−210 V, the value of the applied voltage to the developing roller 34*c* of the developing device 17*c* was Vbias=−220 V, and the value of the applied voltage to the developing roller 34*d* of the developing device 17*d* was Vbias=−230 V. The electrostatic latent image voltage $V_L$ here was −50 V, and therefore the developing voltage of the developing roller 34*a* became $|V_L-Vbias|=150$ V, and the developing voltage of the developing roller 34*b* became $|V_L-Vbias|=160$ V, and the developing voltage of the developing roller 34*c* became $|V_L-Vbias|=170$ V, and the developing voltage of the developing roller 34*d* became $|V_L-Vbias|=180$ V. Thus, using the developing voltage $|V_L-Vbias|$ of the developing roller 34*a* as a reference, the developing voltage was set to become gradually high at a rate of 7% toward the downstream side.

Further, the BG, ID and gradation of the color image of 0 K and the color image of 40 K were respectively measured and evaluated. Table 3 shows results thereof.

Comparative Example 6

A color image was formed in the same manner as Example 1, except that the respective values of the applied voltage Vbias of the developing rollers 34*a* through 34*d* of the developing devices 17*a* through 17*d* of the image forming stations Pa through Pd for respective colors of Y, M, C and Bk were assumed to be substantially the same.

Specifically, the value of the applied voltage Vbias of all of the developing rollers 34*a* through 34*d* was Vbias=−200 V. The electrostatic latent image $V_L$ here was −50 V, and therefore the developing voltage of the developing rollers 34*a* through 34*d* became $|V_L-Vbias|=150$ V.

Further, the BG, ID and gradation of the color image 0 K and the color image of 40 K were respectively measured and evaluated. Table 3 shows results thereof.

TABLE 3

| | B G | | I D | | Gradation | |
|---|---|---|---|---|---|---|
| | 0 K | 40 K | 0 K | 40 K | 0 K | 40 K |
| 3rd Embodiment | ○ | ○ | ○ | ○ | ○ | ○ |
| C/Example 5 | ○ | ○ | ○ | Δ | ○ | x |
| C/Example 6 | ○ | Δ | ○ | x | ○ | Δ |

N.B. "C/Example" = Comparative Example

Thus, when controlling the developing voltage ($|V_L-Vbias|$) for developing the electrostatic latent image corresponding to each color, in Example 3, desirable results were obtained in the BG, ID and gradation of both of 0 K and 40 K. Consequently, according to the present invention, occurrence of the back-transfer phenomenon can sufficiently be suppressed in the image forming station of the downstream side in the transfer process, thus forming a desirable color image.

On the other hand, in Comparative Example 5, fog was not observed in both of 0 K and 40 K, but in 40 K, the density is reduced to some extent and the gradation in particular was largely reduced, and thereby a desirable color image was not obtained. Further, in Comparative Example 6, desirable results were obtained in the BG, ID and gradation of 0 K, but in 40 K, occurrence of fog and/or reduction in gradation to some extent could not be prevented, and the density in particular was largely reduced, and thereby a desirable color image was not obtained.

Example 4

A color image was formed in the same manner as Example 2, except that a particle size of toner of Y to be used in the developing device 17*a* of the image forming station Pa for forming the first-color toner image (Y) was assumed to be the maximum, and a particle size of toner of each color was set to become large at a predetermined rate with respect to the developing device 17*b* of the image forming station Pb for transferring the second-color toner image (M), the developing device 17*c* of the image forming station Pc for transferring the third-color toner image (C), and the developing device 17*d* of the image forming station Pd for transferring the fourth-color toner image (Bk), in this order.

Specifically, toner of the respective color of Y, M, C and Bk was obtained in the same manner as in the foregoing manufacturing samples of toner, except that the classifying step was carried out so that the particle size of Y falls within a range of not less than 7 μm and not more than 7.5 μm, and a particle size of M falls within a range of not less than 8 μm and not more than 8.5 μm, and a particle size of C falls within a range of not less than 9 μm and not more than 9.5 μm, and a particle size of Bk falls within a range of not less than 10 μm and not more than 10.5 μm. Thus, using the particle size of toner of the first color Y as a reference, the particle size was set to gradually become large at a rate of 15% toward the downstream side.

Further, the BG, ID and gradation of the color image of 0 K and the color image of 40 K were respectively measured and evaluated. Table 4 shows results thereof.

Comparative Example 7

A color image was formed in the same manner as Example 2, except that the particle size of toner of Y to be used in the developing device 17*a* of the image forming station Pa for forming the first-color toner image (Y) was assumed to be the minimum, and the particle size of toner of each color was set to become small at a predetermined rate with respect to the developing device 17*b* of the image forming station Pb for transferring the second-color toner image (M) , the developing device 17*c* of the image forming station Pc for transferring the third-color toner image (C), and the developing device 17*d* of the image forming station Pd for transferring the fourth-color toner image (Bk), in this order.

Specifically, toner of the respective color of Y, M, C and Bk was obtained in the same manner as in the foregoing manufacturing samples of toner, except that the classifying step was carried out so that the particle size of Y falls within a range of not less than 10 μm and not more than 11 μm, and the particle size of M falls within a range of not less than 9 μm and not more than 9.5μm, and the particle size of C falls within a range of not less than 8 μm and not more than 8.5 μm, and the particle size of Bk falls within a range of not less than 6 μm and not more than 7 μm. Thus, using the particle size of toner of the first color Y as a reference, the particle size was set to gradually become small at a rate of 10% toward the downstream side.

Further, the BG, ID and gradation of the color image of 0 K and the color image of 40 K were respectively measured and evaluated. Table 4 shows results thereof.

Comparative Example 8

A color image was formed in the same manner as Example 2, except that toner was produced so that the particle sizes of toner of the respective colors of Y, M, C and Bk were set to become substantially the same.

Specifically, toner of the respective colors of Y, M, C and Bk was obtained in the same manner as in the foregoing manufacturing sample of toner, except that the classifying step was carried out so that the particle sizes of the respective toner of Y, M, C and Bk all fall within a range of not less than 8 μm and not more than 8.5 μm.

Further, the BG, ID and gradation of the color image 0 K and the color image of 40 K were respectively measured and evaluated. Table 4 shows results thereof.

TABLE 4

| | B G | | I D | | Gradation | |
|---|---|---|---|---|---|---|
| | 0 K | 40 K | 0 K | 40 K | 0 K | 40 K |
| 4th Embodiment | ○ | ○ | ○ | ○ | ○ | ○ |
| C/Example 7 | ○ | Δ | ○ | ○ | Δ | Δ |
| C/Example 8 | ○ | Δ | ○ | x | ○ | Δ |

N.B. "C/Example" = Comparative Example

Thus, when changing an average particle size for each color as developer for developing the electrostatic latent image corresponding to each color, in Example 4, desirable results were obtained in all of the BG, ID and gradation of both of the 0 K and 40 K. Therefore, according to the present invention, occurrence of the back-transfer phenomenon can sufficiently be suppressed in the image forming station of the downstream side in the transfer process, thus forming a desirable color image.

On the other hand, in Comparative Example 7, the density was not reduced in both of 0 K and 40 K, but fog was observed to some extent in 40 K, and further, gradation was reduced to some extent in both of 0 K and 40 K, and thus a desirable color image could not be obtained. Further, in Comparative Example 8, in 0 K, desirable results were obtained in all of the BG, ID and gradation, but in 40 K, occurrence of fog and/or reduction in gradation to some extent could not be prevented, and the density in particular was largely reduced, and thus a desirable color image was not obtained.

In this manner, the image forming device according to the present invention includes toner image forming means for forming toner images corresponding to respective colors and a black color which respectively form a color image and a monochromatic (black and white) image; an intermediate transfer belt to which the toner images of each color and the black color, which were formed by the toner image forming means, are transferred; and transfer means for transferring the toner images on the intermediate transfer belt onto a recording medium, wherein the toner image forming means of respective colors which form the color image are disposed on one side of the intermediate transfer belt, and the toner image forming means of the black color is disposed on the other side of the intermediate transfer belt and in a vicinity of an upstream side of the transfer means so as to dispose it on a most downstream side of all the toner image forming means.

With the foregoing arrangement, by disposing only the toner image forming means of the black color on the other side of the intermediate transfer belt and on the most downstream side of all the toner image forming means, it is possible to suppress the size of the entire device, to increase the size of the toner image forming means of the black color which is frequently used in image formation, and to increase the first copying speed of monochromatic image formation which is frequently used in image formation.

The image forming device according to the present invention has an arrangement in which the toner image forming means of the black color is disposed side by side along the intermediate transfer belt. In addition, the intermediate transfer belt is suspended horizontally, and paper feeding means is disposed beneath the intermediate transfer belt, and between the intermediate transfer belt and the paper feeding means is disposed the toner image forming means of the black color side by side.

With the foregoing arrangement, space inside the device can be utilized effectively, thereby increasing the size of the black toner image forming means.

The image forming device according to the present invention has an arrangement in which the black toner image forming means is made up of a photoreceptor and a developing device for supplying the photoreceptor with toner so as to form a toner image, and the photoreceptor is disposed on a side of a feeder roller for feeding a recording medium in paper feeding means, and a developer tank is disposed along the intermediate transfer belt on the opposite side to the feeder roller and next to the photoreceptor.

With the foregoing arrangement, since the developer tank is disposed on a side where the feeder roller of the paper feeding means is not provided, i.e., on a lower part in a direction of height of the paper feeding means, a spacing between the paper feeding means and the intermediate transfer belt can be effectively utilized, greatly reducing the size of the entire device.

The image forming device according to the present invention has an arrangement in which the black toner image forming means is formed of the developing device which uses two-component developer, and the toner image forming means of respective colors are formed of the developing devices use one-component developer, and further, a diameter of a photoreceptor of the black toner image forming means is formed to be larger than a diameter of a photoreceptor of the toner image forming means of respective colors.

With the foregoing arrangement, a longer life cycle of the black toner image forming means can be attained, and the number of time for replacement of the toner image forming means of the black color which is frequently used in image formation can be reduced, thereby increasing ease of use.

The image forming device according to the present invention has an arrangement in which the toner image forming means is made up of the photoreceptor, exposing means for forming an electrostatic latent image on a surface of the photoreceptor which was exposed, and the developing device for developing the electrostatic latent image into a toner image, wherein the toner image forming means of respective colors, but at least not the black color, are formed of an LED array.

With the foregoing arrangement, the size of the entire device can be greatly reduced.

The image forming device according to the present invention has an arrangement in which the intermediate transfer belt is horizontally suspended, and the paper feeding means is disposed beneath the intermediate transfer belt, and a paper discharge section for discharging a recording medium on which an image was formed is disposed above the intermediate transfer belt, and a transport path for transporting the recording medium from the paper feeding means to the paper discharge section via a transfer portion of the transfer means is vertically formed, and fixing means for fixing the toner image on the recording medium is disposed above the transfer means in the paper discharge path.

With the foregoing arrangement, since the fixing means to have a high temperature is disposed above the transfer means, for example, decay of a blade which cleans residual toner on the intermediate transfer belt, which may be caused by the heat of the high temperature, can be prevented.

The image forming means according to the present invention has an arrangement in which the intermediate transfer belt is suspended so that a transfer portion to which a toner image is transferred from the toner image forming means is disposed in a substantially horizontal direction, and that a portion thereof between a downstream side of the transfer means and a most upstream side of a plurality of toner image forming means is disposed in a substantially vertical direction, and cleaning means for cleaning residual toner on the intermediate transfer belt is disposed on a portion of the intermediate transfer belt suspended in the substantially vertical direction.

With the foregoing arrangement, by cleaning residual toner on a substantially vertical portion of the intermediate transfer belt, the residual toner can surely be cleaned.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming device, comprising:

a plurality of toner image forming means for respectively forming toner images of different colors, and an intermediate transfer belt on which the toner images which are respectively formed by said plurality of toner image forming means are successively transferred one over another, said image forming device further comprising, as said plurality of toner image forming means, one or more chromatic color toner image forming means for forming a toner image having a chromatic color, and only one black toner image forming means for forming a toner image having a black color, and said intermediate transfer belt being suspended in a shape of a substantially flat plate by at least two suspension rollers inside a main body, and said chromatic color toner image forming means being disposed on one side of the suspended intermediate transfer belt, and said black toner image forming means being disposed on the other side of the intermediate transfer belt, alone and on a most downstream side of all the toner image forming means.

2. The image forming device as set forth in claim 1, wherein said black toner image forming means has a form of a substantially flat plate which extends two-dimensionally, and is disposed in such a manner that a direction of the two-dimensional extension is along a suspending direction of said intermediate transfer belt.

3. The image forming device as set forth in claim 2, wherein:

said black toner image forming means includes an image carrier for carrying an electrostatic latent image, developing means for developing the electrostatic latent image by toner so as to form a toner image, and a developer tank for storing toner, and said image carrier, said developing means and said developer tank are disposed in this order side by side in one direction, taking the form of the substantially flat plate.

4. The image forming device as set forth in claim 1, wherein:

said intermediate transfer belt is suspended in a substantially horizontal direction in the main body, and a recording medium storing section for storing a recording medium, to which a toner image is finally transferred, is disposed in the main body along a suspending direction of said intermediate transfer belt, and said black toner image forming means is disposed in a spacing having the form of the substantially flat plate between said intermediate transfer belt and said recording medium storing section.

5. The image forming device as set forth in claim 1, further comprising:

final transfer means for finally transferring a toner image, which has been transferred onto the intermediate transfer belt, to a recording medium;

fixing means for fixing the toner image, which was finally transferred, on the recording medium; and a transport path for transporting the recording medium from a recording medium storing section to the fixing means via the final transfer means, wherein:

said intermediate transfer belt is suspended in a substantially horizontal direction inside the main body, and said transport path is disposed in a substantially vertical direction, and said recording medium storing section is disposed in a lower part of the main body.

6. The image forming device as set forth in claim 5, wherein:

said recording medium storing section further comprises a feeding roller for feeding the recording medium into the transport path, and said black toner image forming means is disposed in a spacing having a form of a substantially flat plate between said intermediate transfer belt and said recording medium storing section.

7. The image forming device as set forth in claim 1, wherein an image carrier for carrying an electrostatic latent image, included in said plurality of the toner image forming means, has a substantially cylindrical shape, and a diameter of the image carrier of said black toner image forming means is larger than a diameter of an image carrier of the chromatic color image forming means.

8. The image forming device as set forth in claim 1, wherein:

said plurality of the toner image forming means have exposing means for exposing a surface of an image carrier for carrying an electrostatic latent image so as to form the electrostatic latent image, and as said exposing means is employed at least either one of a laser scan unit and a light-emitting diode array.

9. The image forming device as set forth in claim 8, wherein as exposing means of said chromatic color toner image forming means is employed the light-emitting diode array.

10. The image forming device as set forth in claim 1, further comprising cleaning means for cleaning residual toner on the intermediate transfer belt, wherein:

said intermediate transfer belt which is suspended in the shape of the substantially flat plate is suspended by two suspension rollers which are disposed adjacently in a substantially vertical direction, and by one suspension roller which is disposed in a position apart from the two suspension rollers, and said cleaning means is disposed so as to face the intermediate transfer belt which is suspended in a substantially vertical direction by said two suspension rollers which are disposed adjacently.

11. The image forming device as set forth in claim 1, wherein said black toner image forming means uses two-component component developer including toner and carrier, while said chromatic color toner image forming means uses one-component developer including toner.

12. The image forming device as set forth in claim 1, wherein a disposed position of one of the at least two suspension rollers suspending the intermediate transfer belt is set above the other suspension roller with respect to a horizontal direction so as to suspend the intermediate transfer belt with a tilt.

13. An image forming device, wherein:

a plurality of toner image forming means for forming and transferring toner images onto a transfer medium are disposed side by side along a transport or moving direction of said transfer medium so as to allow the plurality of toner images to be successively transferred one over another with respect to said transfer medium, and said plurality of toner image forming means have transfer means for transferring the formed toner images to the transfer medium, and a transfer voltage of the transfer means in toner image forming means on a downstream side of the transport or moving direction is set to be lower than a transfer voltage of the transfer means in toner image forming means on an upstream side.

14. The image forming device as set forth in claim 13, wherein:

as said plurality of toner image forming means are provided one or more chromatic color toner image forming means for forming a toner image having a chromatic color, and only one black toner image forming means for forming a toner image having a black color, and said transfer medium is an intermediate transfer belt having a shape of a belt and being suspended in a horizontal direction inside a main body, and said chromatic color toner image forming means is disposed side by side on one side of said intermediate transfer belt, and said black toner image forming means is disposed on the other side of said intermediate transfer belt, alone and on a most downstream side of all the toner image forming means.

15. An image forming device, wherein:

a plurality of toner image forming means for forming and transferring toner images onto a transfer medium are disposed side by side along a transport or moving direction of said transfer medium so as to allow the plurality of toner images to be successively transferred one over another with respect to said transfer medium, and a quantity of a charge of toner which is used in toner image forming means on a downstream side of the transport or moving direction is set to be lower than a quantity of a charge of toner which is used in toner image forming means on an upstream side, wherein: as said plurality of the toner image forming means are provided one or more chromatic color toner image forming means for forming a toner image having a chromatic color, and only one black toner image forming means for forming a toner image having a black color, and said transfer medium is an intermediate transfer belt having a shape of a belt and being suspended in a horizontal direction inside a main body, and said chromatic color toner image forming means are disposed side by side on one side of said intermediate transfer belt, and said black toner image forming means is disposed on the other side of said intermediate transfer belt, alone and on a most downstream side of all the toner image forming means.

16. An image forming device, wherein:

a plurality of toner image forming means for forming and transferring a toner image onto a transfer medium are disposed side by side along a transport or moving direction of said transfer medium so as to allow a plurality of toner images to be successively transferred one over another with respect to said transfer medium, and said plurality of toner image forming means include an image carrier for carrying an electrostatic latent image, and developing means for developing the electrostatic latent image which is carried by said image carrier, and a developing potential of the developing means in toner image forming means on a downstream side in the transport or moving direction is set to be lower than a developing potential of the developing means in toner image forming means on an upstream side.

17. The image forming device as set forth in claim 16, wherein the developing potential is set by one method which is selected from the group consisting of: a method of varying a voltage applied to the developing means while holding an electrostatic latent image potential constant, and a method of varying the electrostatic latent image potential while holding the voltage applied to the developing means constant.

18. The image forming device as set forth in claim 16, wherein:

as said plurality of the toner image forming means are provided one or more chromatic color toner image forming means for forming a toner image having a chromatic color, and only one black toner image forming means for forming a toner image having a black color, and said transfer medium is an intermediate transfer belt having a shape of a belt and being suspended in a horizontal direction inside a main body, and said chromatic color toner image forming means are disposed side by side on one side of said intermediate transfer belt, and said black toner image forming means is disposed on the other side of said intermediate transfer belt, alone and on a most downstream side of all the toner image forming means.

19. An image forming device, wherein:

a plurality of toner image forming means for forming and transferring toner images onto a transfer medium are disposed side by side along a transport or moving direction of said transfer medium so as to allow the plurality of toner images to be successively transferred one over another with respect to said transfer medium, and a particle size of toner which is used in toner image forming means on a downstream side in the transport or moving direction is set to be larger than a particle size of toner which is used in toner image forming means on an upstream side, wherein as said plurality of the toner image forming means are provided one or more chromatic color toner image forming means for forming a toner image having a chromatic color, and only one black toner image forming means for forming a toner image having a black color, and said transfer medium is an intermediate transfer belt having a shape of a belt and being suspended in a horizontal direction inside a main body, and said chromatic color toner image forming means are disposed side by side on one side of said intermediate transfer belt, and said black toner image forming means is disposed on the other side of said intermediate transfer belt, alone and on a most downstream side of all the toner image forming means.

* * * * *